US011149761B2

(12) United States Patent
Ito et al.

(10) Patent No.: US 11,149,761 B2
(45) Date of Patent: Oct. 19, 2021

(54) FLUID ACTUATOR

(71) Applicant: NABTESCO CORPORATION, Tokyo (JP)

(72) Inventors: Koji Ito, Tokyo (JP); Keigo Futamata, Tokyo (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 16/936,082

(22) Filed: Jul. 22, 2020

(65) Prior Publication Data

US 2021/0040962 A1 Feb. 11, 2021

(30) Foreign Application Priority Data

Aug. 7, 2019 (JP) ..... JP2019-145247

(51) Int. Cl.
*F15B 15/14* (2006.01)
*F15B 13/04* (2006.01)

(52) U.S. Cl.
CPC ..... *F15B 15/1404* (2013.01); *F15B 13/04* (2013.01); *F15B 15/1428* (2013.01)

(58) Field of Classification Search
CPC ..... F15B 15/1428; F15B 15/1404
See application file for complete search history.

(56) References Cited

U.S. PATENT DOCUMENTS 4,296,677 A 10/1981 Little et al.
4,685,384 A * 8/1987 Dirkin ..... B29C 63/0021 92/166
5,241,896 A * 9/1993 Braun ..... F01B 11/001 92/128
6,981,439 B2 1/2006 Hart
2017/0314579 A1* 11/2017 Berthelsen ..... F15B 13/0405
2017/0314581 A1* 11/2017 Landberg ..... F15B 15/1447
2018/0128291 A1* 5/2018 Sefcik ..... F15B 15/1433

FOREIGN PATENT DOCUMENTS

DE 102016102373 A1 8/2017
FR 2865951 A3 8/2005
JP 3652642 B2 5/2005

OTHER PUBLICATIONS

Extended European Search Report for EP Application No. 20188994.6 dated Dec. 11, 2020 (8 pgs).

* cited by examiner

*Primary Examiner* — Frank Daniel Lopez
(74) *Attorney, Agent, or Firm* — Pillsbury Winthrop Shaw Pittman, LLP

(57) ABSTRACT

One object is to reduce a weight of a fluid actuator. The fluid actuator includes: a cylinder having an inner space and a first mounting portion, the inner space being partitioned into a first fluid chamber and a second fluid chamber, the first mounting portion being disposed on an end portion of the cylinder on an axial direction A side; and a piston rod configured to reciprocate in accordance with pressures in the fluid chambers. A wall portion defining the first fluid chamber in the cylinder is made of an iron-based alloy. A wall portion defining the second fluid chamber in the cylinder is made of an aluminum alloy. The piston rod is made of an iron-based alloy.

5 Claims, 11 Drawing Sheets

FLUID ACTUATOR

CROSS-REFERENCE TO RELATED APPLICATIONS

This application is based on and claims the benefit of priority from Japanese Patent Application Serial No. 2019-145247 (filed on Aug. 7, 2019), the contents of which are hereby incorporated by reference in their entirety.

TECHNICAL FIELD

The present invention relates to a fluid actuator.

BACKGROUND

In the fluid actuator disclosed in Japanese Patent No. 3652642 ("the '642 Patent"), a fluid chamber is defined within a cylinder. The cylinder contains a piston that partitions the fluid chamber into two chambers. Variation of the pressure of the fluid fed into the fluid chamber causes the piston to reciprocate, and an object mounted to the piston is moved in accordance with the reciprocation of the piston.

In actuators such as disclosed in the '642 Patent, the cylinder and other members are made of a highly rigid material such that they can withstand a pressure of the fluid fed into the fluid chamber and external impacts. However, in general, a material having a certain degree of rigidity, such as stainless steels, has a large weight. Therefore, it is difficult to reduce the weight of fluid actuators.

SUMMARY

The present invention addresses such circumstances, and one object thereof is to provide a lightweight fluid actuator.

A fluid actuator for achieving the above object comprises: a cylinder having a columnar inner space and a mounting portion, the inner space being partitioned into a plurality of fluid chambers arranged in an axial direction of the inner space, the mounting portion being disposed on an end portion of the cylinder on one axial direction side of the inner space and configured to be mounted to an external object; and a piston rod extending across the plurality of fluid chambers and having a piston partitioning each of the plurality of fluid chambers into two chambers, the piston rod being configured to reciprocate in the axial direction in accordance with pressures in the plurality of fluid chambers, wherein in the cylinder, a wall portion partitioning one of the plurality of fluid chambers positioned at an end on the one axial direction side is made of an iron-based alloy, and a radial wall portion partitioning another of the plurality of fluid chambers positioned on the other axial direction side beyond the one of the plurality of fluid chambers positioned at the end on the one axial direction side is made of an aluminum alloy, and wherein the piston rod is made of an iron-based alloy.

The cylinder is basically required to have rigidity, for example, in the vicinity of the mounting portion. In addition, in the cylinder, a pressure produced by movement of the piston tends to act on the wall portions positioned on the axis of the cylinder such as the wall portion partitioning adjacent fluid chambers. Therefore, a high rigidity is required in these wall portions. On the other hand, the wall portions defining the radially outer side of the fluid chambers receive less pressure produced by the movement of the piston. Therefore, the wall portions defining the radially outer side of the fluid chambers are not required to have as high a rigidity as the portions in the vicinity of the coupling portion. Such wall portions can be made of an aluminum alloy to reduce the weight of the cylinder. As a result, the weight of the fluid actuator can be reduced.

It is possible that the fluid actuator further includes a manifold mounted to the cylinder and containing a hydraulic circuit of a fluid to be fed to and discharged from the fluid chambers, and the manifold is made of an aluminum alloy. Since the manifold mounted to the cylinder is made of an aluminum alloy, the weight of the fluid actuator can be reduced.

In the fluid actuator, it is possible that the fluid circuit and the plurality of fluid chambers are connected via a pipe extending from the manifold to the cylinder.

Since the manifold and the cylinder are connected via a pipe, the manifold does not need to extend to the vicinity of the fluid chambers in the cylinder, and thus the manifold can be downsized.

In the fluid actuator, supposing that the two chambers of each of the fluid chambers partitioned by the piston include a first partition chamber on the one axial direction side and a second partition chamber on the other axial direction side, a cross-sectional area orthogonal to the axial direction related to the first partition chamber may be different from a cross-sectional area orthogonal to the axial direction related to the second partition chamber.

The piston rod may move in accordance with the movement of an external object mounted to the piston rod. At a moment when the piston rod moves, the piston rod will move with substantially no fluid flowing into or out of the first partition chamber and the second partition chamber. In the above configuration, the first partition chamber and the second partition chamber have different cross-sectional areas. Therefore, when the piston is positioned around the axial middle of a fluid chamber, the first partition chamber and the second partition chamber have different volumes. In this configuration, when substantially no fluid flows into or out of the first partition chamber and the second partition chamber, a force acts on the piston in the direction described as follows. The force acts from the first or second partition chamber having the larger volume produced by the larger cross-sectional area toward the other partition chamber having the smaller volume produced by the smaller cross-sectional area. For example, when in some of the plurality of fluid chambers, the first partition chamber has the larger orthogonal cross-sectional area, while in the other fluid chambers, the second partition chamber has the larger orthogonal cross-sectional area, and these fluid chambers are arranged randomly, the piston rod receives a force acting toward the one axial direction side of the cylinder and a force acting toward the other axial direction side. The piston rod receiving these forces is inhibited from moving in the axial direction. This is favorable in suppressing the movement of the piston rod.

In the fluid actuator, there are two fluid chambers provided. In one of the two fluid chambers, the partition chamber having the larger cross-sectional area among the two partition chambers may be positioned on the one axial direction side, while in the other fluid chamber, the partition chamber having the larger cross-sectional area among the two partition chambers may be positioned on the other axial direction side.

For example, in the fluid chamber on the one axial direction side of the cylinder, the first partition chamber has a larger cross-sectional area than the second partition chamber, while in the other fluid chamber, the second partition chamber has a larger cross-sectional area than the first partition chamber. In this configuration, at a moment when the piston rod moves in accordance with the movement of an external object mounted to the piston rod, or when substantially no fluid flows into or out of the first partition chamber and the second partition chamber, the piston supposed to be positioned around the axial middle of the fluid chamber receives forces acting thereon in the directions described as follows. In the fluid chamber on the one axial direction side, a force acts from the first partition chamber toward the second partition chamber, or toward the other axial direction side of the cylinder. In the fluid chamber on the other axial direction side, a force acts from the second partition chamber toward the first partition chamber, or toward the one axial direction side of the cylinder. In other words, with respect to the axial direction of the cylinder, the piston rod receives the forces acting thereon from both its sides toward the middle of the cylinder, and therefore, the piston rod is easily retained in the position around the middle.

DESCRIPTION OF THE EMBODIMENTS

An embodiment of a fluid actuator system including a fluid actuator is hereinafter described. A fluid actuator system is used for operation of a flap of an aircraft.

Figure 1:
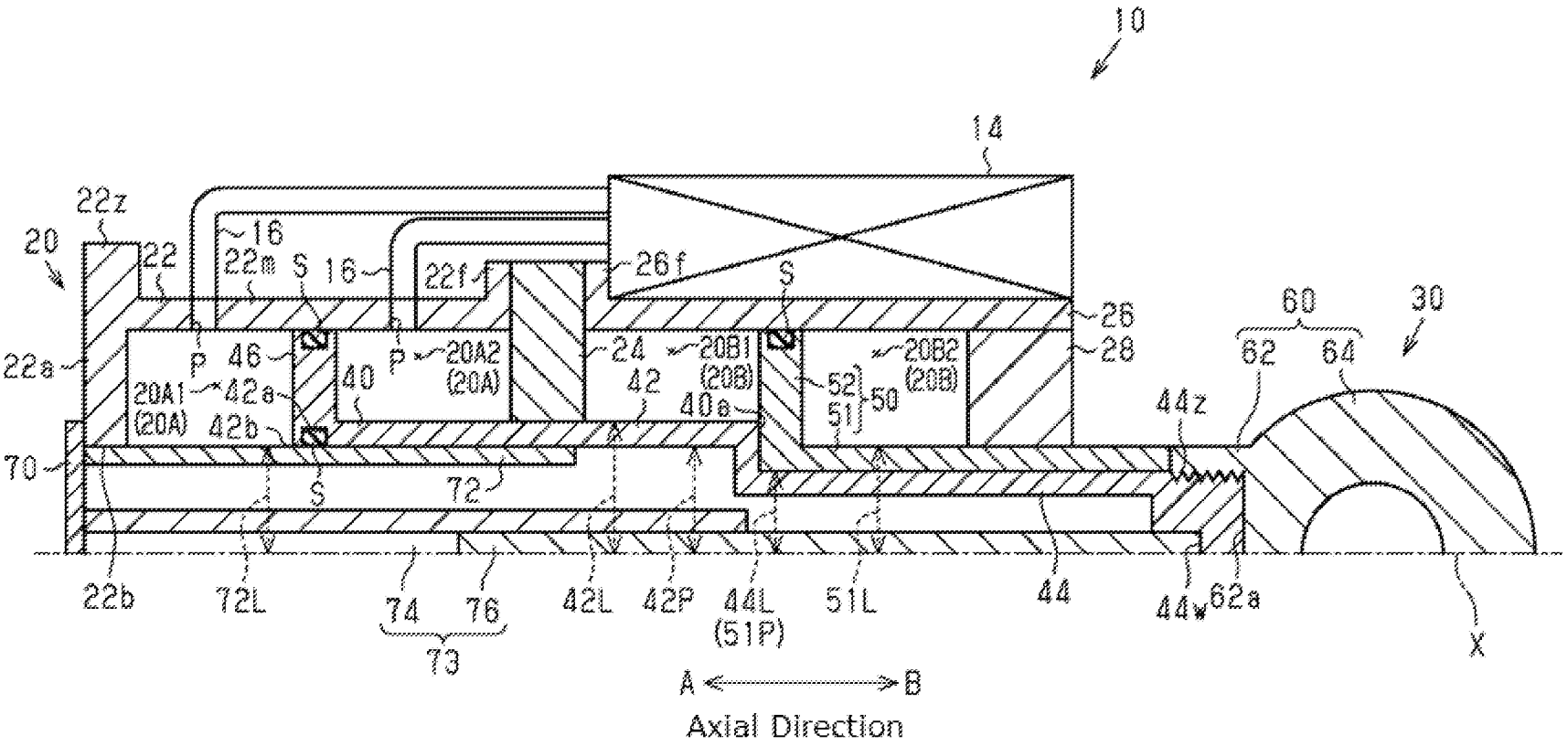
FIG. 1 is a longitudinal section of a fluid actuator.

First, a fluid actuator is described. As shown in FIG. 1, a cylinder 20 of a fluid actuator 10 includes a first cylinder unit 22. A main body 22*m* of the first cylinder unit 22 has a cylindrical shape. The central axis X of the main body 22*m* of the first cylinder unit 22 is the central axis of the cylinder 20. The main body 22*m* of the first cylinder unit 22 is closed at an end thereof on the axial direction A side with an end wall 22*a*. The end wall 22*a* is penetrated by a bottom through-hole 22*b* having a circular shape in plan view. The central axis of the bottom through-hole 22*b* is aligned with the central axis X of the main body 22*m* of the first cylinder unit 22. A first mounting portion 22*z* projects outward from the outer peripheral surface of the main body 22*m* of the first cylinder unit 22. The first mounting portion 22*z* is used to mount an external object to the cylinder 20. The first mounting portion 22*z* has a plate-like shape. The first mounting portion 22*z* is positioned on the end portion of the main body 22*m* of the first cylinder unit 22 on the axial direction A side. Although not shown, the first mounting portion 22*z* has a boss or the like to be penetrated by a bolt for mounting the fluid actuator 10 to an external object. In this embodiment, the first cylinder unit 22 is mounted to an airframe of an aircraft via the first mounting portion 22*z*. In the axial direction, the side where the first mounting portion 22*z* is positioned is "the axial direction A side" corresponding to "one axial direction side," and the side opposite to the A side is "the axial direction B side" corresponding to "the other axial direction side."

A flange 22*f* projects outward from the outer peripheral surface of the main body 22*m* of the first cylinder unit 22. The flange 22*f* is positioned at the end of the main body 22*m* of the first cylinder unit 22 on the axial direction B side. The flange 22*f* extends over the entire circumference of the main body 22*m* of the first cylinder unit 22. The outer peripheral wall of the main body 22*m* of the first cylinder unit 22 is penetrated by two ports P. One of the two ports P is provided on the A side and the other on the B side of the axial middle of the main body 22*m* of the first cylinder unit 22. The material of the first cylinder unit 22 is a stainless steel. Specifically, all the wall portions constituting the main body 22*m* of the first cylinder unit 22, the end wall 22*a*, the first mounting portion 22*z*, and the flange 22*f* are made of a stainless steel, or an iron-based alloy.

A second cylinder unit 24, which has an annular shape in plan view, is disposed on the end surface of the main body 22*m* of the first cylinder unit 22 on the axial direction B side. The second cylinder unit 24 is coaxial with the main body 22*m* of the first cylinder unit 22. The inner diameter of the second cylinder unit 24 is smaller than that of the main body 22*m* of the first cylinder unit 22 and is larger than the diameter of the bottom through-hole 22*b* of the first cylinder unit 22. The material of the second cylinder unit 24 is bronze.

A third cylinder unit 26, which has a cylindrical shape, is disposed on the opposite side to the first cylinder unit 22 with respect to the second cylinder unit 24. The third cylinder unit 26 is coaxial with the second cylinder unit 24. The inner diameter and the outer diameter of the third cylinder unit 26 are equal to the inner diameter and the outer diameter of the main body 22*m* of the first cylinder unit 22, respectively. A flange 26*f* projects outward from the outer peripheral surface of the third cylinder unit 26. The flange 26*f* is positioned at the end of the third cylinder unit 26 on the axial direction A side. The flange 26*f* extends over the entire circumference of the end of the third cylinder unit 26. The outer diameter of the flange 26*f* is equal to the outer diameter of the flange 22*f* of the first cylinder unit 22. The flange 26*f* is integrally connected to the flange 22*f* of the first cylinder unit 22 and the second cylinder unit 24 with a bolt (not shown), in such an arrangement that the second cylinder unit 24 is interposed between the flange 26*f* and the flange 22*f* of the first cylinder unit 22.

The outer peripheral wall of the third cylinder unit 26 is penetrated by two ports. One of the two ports is provided on the A side and the other on the B side of the axial middle of the third cylinder unit 26. The ports of the third cylinder unit 26 are not shown in FIG. 1 since they are at positions different from the longitudinal section shown in FIG. 1. The material of the third cylinder unit 26 is an aluminum alloy. Specifically, all the wall portions constituting the third cylinder unit 26 are made of an aluminum alloy.

A fourth cylinder unit 28, which has an annular shape in plan view, is disposed on the end portion of the third cylinder unit 26 on the axial direction B side. The fourth cylinder unit 28 is disposed in the third cylinder unit 26. The fourth cylinder unit 28 is coaxial with the third cylinder unit 26.

The outer diameter of the fourth cylinder unit 28 is equal to the inner diameter of the third cylinder unit 26. In other words, the fourth cylinder unit 28 closes the end of the third cylinder unit 26 on the axial direction B side. The material of the fourth cylinder unit 28 is a stainless steel.

As described above, the cylinder 20 is integrally assembled of the first cylinder unit 22, the second cylinder unit 24, the third cylinder unit 26, and the fourth cylinder unit 28 into a shape of a cylinder with closed opposite ends as a whole. In other words, the cylinder 20 has a columnar inner space. The bottom portion of the cylinder 20 on the axial direction A side is constituted by the end wall 22*a* of the first cylinder unit 22, and the bottom portion of the cylinder 20 on the axial direction B side is constituted by the fourth cylinder unit 28. The inner space of the cylinder 20 is partitioned into two chambers arranged in the axial direction by the second cylinder unit 24 as a boundary. In other words, the cylinder 20 contains a first fluid chamber 20A and a second fluid chamber 20B defined therein and arranged in the axial direction thereof, the first fluid chamber 20A is positioned on the axial direction A side, and the second fluid chamber 20B is positioned on the axial direction B side.

On the outer peripheral surface of the cylinder 20, there is mounted a manifold 14 containing a circuit (hereinafter referred to as "the hydraulic circuit") of a hydraulic fluid fed into and discharged from the first fluid chamber 20A and the second fluid chamber 20B. The manifold 14 as a whole has a rectangular parallelepiped shape. The manifold 14 extends over the entire location of the third cylinder unit 26 in the axial direction of the cylinder 20. The manifold 14 is disposed integrally with the cylinder 20 so as to extend along the outer peripheral surface of the third cylinder unit 26 in the axial direction of the cylinder 20. The manifold 14 is mounted to the cylinder 20 with a bolt (not shown) via the flange 26*f* of the third cylinder unit 26. The material of the manifold 14 is an aluminum alloy.

Four pipes 16 extend from the manifold 14. FIG. 1 shows only two of the four pipes. Each of the pipes 16 is connected to the hydraulic circuit in the manifold 14. As described above, the cylinder 20 has four ports P. Each of the four pipes 16 is associated with a different port P and is connected to the associated port P. As a result, the fluid circuit is connected to the inner space of the cylinder 20.

The cylinder 20 receives a piston rod 30 therein. The piston rod 30 includes a first piston unit 40 which as a whole has a cylindrical shape. The first piston unit 40 is configured such that both its outer diameter and inner diameter vary in its axially intermediate portion in an associated manner to form a step in the axially intermediate portion. Therefore, the axially A-side portion and the axially B-side portion of the first piston unit 40 have different outer diameters and different inner diameters. Specifically, in the first piston unit 40, the outer diameter 44L of a small diameter portion 44 constituting the B-side portion is smaller than the outer diameter 42L of a large diameter portion 42 constituting the A-side portion. The outer diameter 44L of the small diameter portion 44 is smaller than the inner diameter 42P of the large diameter portion 42. Therefore, the inner diameter of the small diameter portion 44 is also smaller than the inner diameter 42P of the large diameter portion 42. The boundary between the large diameter portion 42 and the small diameter portion 44 forms a step.

A first piston 46 projects outward from the outer peripheral surface of the first piston unit 40. The first piston 46 is positioned at the end of the large diameter portion 42 on the axial direction A side. The first piston 46 extends over the entire circumference of the end of the large diameter portion 42. In the outer peripheral surface of the first piston 46, a groove extends over the entire circumference of the outer peripheral surface. A seal member S is mounted in the groove to block the gap between the first piston 46 and the cylinder 20. In the first piston unit 40, the end portion of the small diameter portion 44 on the axial direction B side forms a screw portion 44*z* having a threaded outer peripheral surface. The end of the small diameter portion 44 on the axial direction B side is closed. The wall portion closing this end has a mounting groove 44*w* formed in the inner surface thereof. As described above, the first piston unit 40 includes the first piston 46, the large diameter portion 42 extending from the first piston 46 toward the axial direction B side, and the small diameter portion 44 extending from the large diameter portion 42 toward the axial direction B side. The end of the large diameter portion 42 on the axial direction A side forms an opening portion 42*b* through which the columnar space in the first piston unit 40 is open toward the axial direction A side.

The small diameter portion 44 of the first piston unit 40 is inserted in a cylindrical member 51 having a cylindrical shape in a second piston unit 50. The inner diameter 51P of the cylindrical member 51 is equal to the outer diameter 44L of the small diameter portion 44 of the first piston unit 40. The outer diameter 51L of the cylindrical member 51 is equal to the inner diameter 42P of the large diameter portion 42 of the first piston unit 40.

A second piston 52 projects outward from the outer peripheral surface of the cylindrical member 51 of the second piston unit 50. The second piston 52 is positioned at the end of the cylindrical member 51 on the axial direction A side. The second piston 52 extends over the entire circumference of the end of the cylindrical member 51. The outer diameter of the second piston 52 is equal to the outer diameter of the first piston 46 of the first piston unit 40. In the outer peripheral surface of the second piston 52, a groove extends over the entire circumference of the outer peripheral surface. A seal member S is mounted in the groove to block the gap between the second piston 52 and the cylinder 20.

The end surface of the cylindrical member 51 of the second piston unit 50 on the axial direction A side contacts with a step surface 40*a* at the boundary between the outer peripheral surface of the large diameter portion 42 and the outer peripheral surface of the small diameter portion 44 of the first piston unit 40. The axial length of the cylindrical member 51 is smaller than that of the small diameter portion 44 of the first piston unit 40. As a result, the cylindrical member 51 does not cover the entirety of the small diameter portion 44 of the first piston unit 40, and the end portion of the small diameter portion 44 on the axial direction B side, or the screw portion 44*z*, is exposed from the cylindrical member 51.

The screw portion 44*z*, which is exposed from the cylindrical member 51 of the second piston unit 50, is threadably engaged with a piston end 60 for mounting an external object to the piston rod 30. Specifically, the piston end 60 includes a coupler 62 having a columnar shape. The coupler 62 is coaxial with the first piston unit 40 and the second piston unit 50. The outer diameter of the coupler 62 is equal to the outer diameter of the cylindrical member 51 of the second piston unit 50. The coupler 62 has a coupling hole 62*a* formed in the end surface thereof on the axial direction A side. The inner surface of the coupling hole 62*a* is threaded. The coupling hole 62*a* is threadably engaged with the screw portion 44*z* of the first piston unit 40. On the other hand, the end surface of the coupler 62 on the axial direction A side and radially outside the coupling hole 62*a* contacts with the end surface of the cylindrical member 51 of the second piston unit 50 on the axial direction B side. The coupler 62 and the step surface 40*a* of the first piston unit 40 compress the cylindrical member 51 interposed therebetween. A second mounting portion 64 for mounting an external object projects from the end surface of the coupler 62 on the axial direction B side. In this embodiment, the second mounting portion 64 is mounted to a flap of an aircraft.

The piston rod 30 configured as described above is received in the cylinder 20 with its central axis aligned with the central axis of the cylinder 20. This situation is as follows. The piston rod 30 extends through a hole inside the fourth cylinder unit that constitutes the bottom portion of the cylinder 20 on the axial direction B side, and the piston rod 30 is inserted in the cylinder 20 from the axial direction B side toward the A side of the cylinder 20. The first piston unit 40 of the piston rod 30 extends through a hole inside the second cylinder unit 24 of the cylinder 20, so as to extend from the axial direction A side to the B side across the second cylinder unit 24. The first piston 46 of the first piston unit 40 is positioned on the axial direction A side of the second cylinder unit 24 of the cylinder 20. Specifically, the first piston 46 is positioned between the two ports P in the first cylinder unit 22. A part of the large diameter portion 42 of the first piston unit 40 is positioned in the hole inside the second cylinder unit 24. The second piston 52 of the second piston unit 50 is positioned on the axial direction B side of the second cylinder unit 24. Specifically, the second piston 52 is positioned between the two ports in the third cylinder unit 26. A part of the cylindrical member 51 of the second piston unit 50 is positioned in the hole inside the fourth cylinder unit 28. The piston end 60 is positioned outside the cylinder 20. The outer diameter of the first piston 46 is equal to the inner diameter of the main body 22*m* of the first cylinder unit 22. The outer diameter 42L of the large diameter portion 42 of the first piston unit 40 is equal to the inner diameter of the second cylinder unit 24. The outer diameter of the second piston 52 is equal to the inner diameter of the third cylinder unit 26. The outer diameter 51L of the cylindrical member 51 of the second piston unit 50 is equal to the inner diameter of the fourth cylinder unit 28.

A fixing member 70 having a plate-like shape is mounted to the end wall 22*a* of the first cylinder unit 22 that constitutes the bottom portion of the cylinder 20 on the axial direction A side. The fixing member 70 provided outside the cylinder 20 closes the bottom through-hole 22*b* in the end wall 22*a* of the first cylinder unit 22. A guide member 72 having a cylindrical shape is fixed to the fixing member 70. The guide member 72 extends through the bottom through-hole 22*b* into the cylinder 20. In other words, the guide member 72 extends from the bottom of the cylinder 20 on the axial direction A side toward the B side. The outer diameter of the guide member 72 is equal to the diameter of the bottom through-hole 22*b*. The outer diameter 72L of the guide member 72 is equal to the inner diameter 42P of the large diameter portion 42 of the first piston unit 40. Accordingly, the outer diameter 72L of the guide member 72 is also equal to the outer diameter 51L of the cylindrical member 51 of the second piston unit 50. The guide member 72 is inserted in the first piston unit 40. The guide member 72 extends to the second cylinder unit 24 with respect to the axial direction of the cylinder 20.

A retaining groove 42*a* is formed in the inner peripheral surface of the large diameter portion 42 of the first piston unit 40 so as to extend over the entire circumference thereof. The retaining groove 42*a* is positioned in the end portion of the large diameter portion 42 on the axial direction A side. A seal member S is mounted in the retaining groove 42*a* to block the gap between the first piston unit 40 and the guide member 72.

With the guide member 72 and the piston rod 30 received in the cylinder 20, each of the first fluid chamber 20A and the second fluid chamber 20B in the cylinder 20 is partitioned into two chambers. Specifically, the first fluid chamber 20A is partitioned into two chambers by the first piston 46 of the first piston unit 40 with respect to the axial direction of the cylinder 20. Of these two chambers, a first partition chamber 20A1 is positioned in the axial direction A side of the cylinder 20, and the radially inner side of the first partition chamber 20A1 is defined by the guide member 72. A second partition chamber 20A2, the other of the two chambers, is positioned in the axial direction B side of the cylinder 20, and the radially inner side of the second partition chamber 20A2 is defined by the large diameter portion 42 of the first piston unit 40. As described above, the outer diameter 72L of the guide member 72 is smaller than the outer diameter 42L of the large diameter portion 42, and therefore, the cross-sectional area orthogonal to the axial direction of the cylinder 20 (hereinafter referred to as "an orthogonal cross-sectional area") related to the first partition chamber20A1 is larger than the orthogonal cross-sectional area related to the second partition chamber 20A2.

The second fluid chamber 20B is partitioned into two chambers by the second piston 52 of the second piston unit 50 with respect to the axial direction of the cylinder 20. Of these two chambers, a first partition chamber 20B1 is positioned in the axial direction A side of the cylinder 20, and the radially inner side of the first partition chamber 20B1 is defined by the large diameter portion 42 of the first piston unit 40. A second partition chamber 20B2, the other of the two chambers, is positioned in the axial direction B side of the cylinder 20, and the radially inner side of the second partition chamber 20B2 is defined by the cylindrical member 51 of the second piston unit 50. As described above, the outer diameter 51L of the cylindrical member 51 of the second piston unit 50 is smaller than the outer diameter 42L of the large diameter portion 42 of the first piston unit 40, and therefore, the orthogonal cross-sectional area related to the second partition chamber 20B2 is larger than the orthogonal cross-sectional area related to the first partition chamber 20B1.

Both the radially inner side of the second partition chamber 20A2 in the first fluid chamber 20A and the radially inner side of the first partition chamber 20B1 in the second fluid chamber 20B are defined by the large diameter portion 42 of the first piston unit 40, and therefore, the partition chambers 20A2, 20B1 have the same orthogonal cross-sectional area. The outer diameter 72L of the guide member 72 that defines the radially inner side of the first partition chamber 20A1 in the first fluid chamber 20A is equal to the outer diameter 51L of the cylindrical member 51 of the second piston unit 50 that defines the radially inner side of the second partition chamber 20B2 in the second fluid chamber 20B, and therefore, the partition chambers 20A1, 20B2 have the same orthogonal cross-sectional area.

An outer member 74 having a cylindrical shape extends from the fixing member 70 into the cylinder 20. The outer member 74 is positioned inside the guide member 72 coaxially with the guide member 72. An inner member 76 having a columnar shape is inserted into the outer member 74 from the axial direction B side of the cylinder 20. The end portion of the inner member 76 on the axial direction B side is fixed to the mounting groove 44*w* provided in the end portion of the first piston unit 40 on the axial direction B side. The position of the inner member 76 relative to the outer member 74 varies as the piston rod 30 reciprocates in the axial direction of the cylinder 20 in accordance with the pressures in the first fluid chamber 20A and the second fluid chamber 20B. The outer member 74 contains a coil with a magnetic field that varies in accordance with the position of the inner member 76, and the variation of the magnetic field is sensed by a sensing circuit (not shown). The sensing circuit, the outer member 74, and the inner member 76 constitute a differential transformer position sensor 73 that senses the position of the piston rod 30 by sensing the position of the inner member 76 relative to the outer member 74.

Next, a channel system of the fluid actuator system is described. Each of the channels in the fluid actuator system is associated with a different fluid chamber of the fluid actuator, or the first fluid chamber 20A or the second fluid chamber 20B. First, the channel associated with the first fluid chamber 20A is described.

Figure 2:
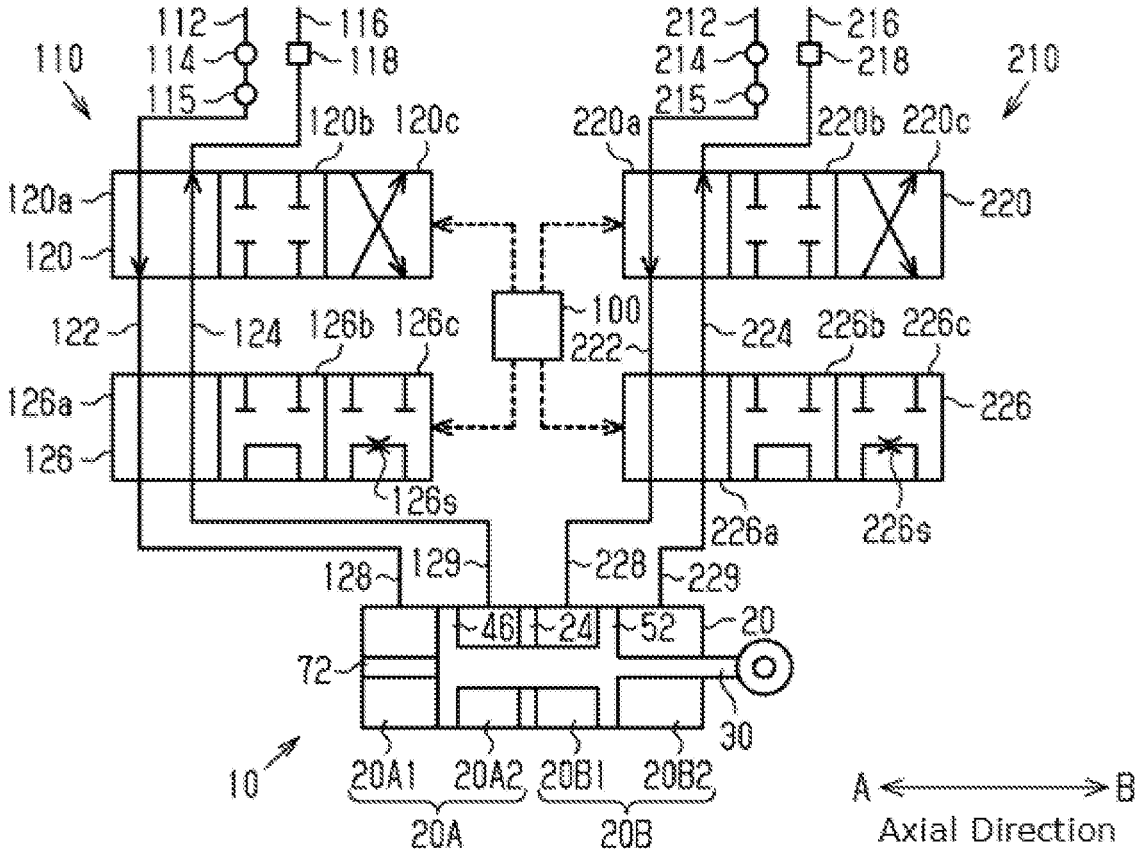
FIG. 2 is a schematic diagram showing a first switching pattern in a fluid actuator system.

Although not shown, the manifold 14 contains a tank for storing a hydraulic fluid. The tank is connected with a first feeding passage 112. As shown in FIG. 2, a pump 114 is installed to an intermediate portion of the first feeding passage 112. Downstream of the pump 114 in the first feeding passage 112, there is provided a check valve 115 for controlling backflow of the hydraulic fluid. At the opposite side to the tank, the first feeding passage 112 is connected to a first passage switching valve 120 formed of a 3-position 4-port valve.

The tank is also connected with a first discharging passage 116. A first compensator 118 is installed to an intermediate portion of the first discharging passage 116. The first compensator 118 stores the hydraulic fluid for replenishment. At the opposite side to the tank, the first discharging passage 116 is connected to the first passage switching valve 120. The first compensator 118 feeds the stored hydraulic fluid toward the first passage switching valve 120 in accordance with the pressure on the first passage switching valve 120 side. When receiving a pressure at a certain or higher level from the first passage switching valve 120 side, the first compensator 118 discharges the hydraulic fluid toward the tank.

Figure 3:
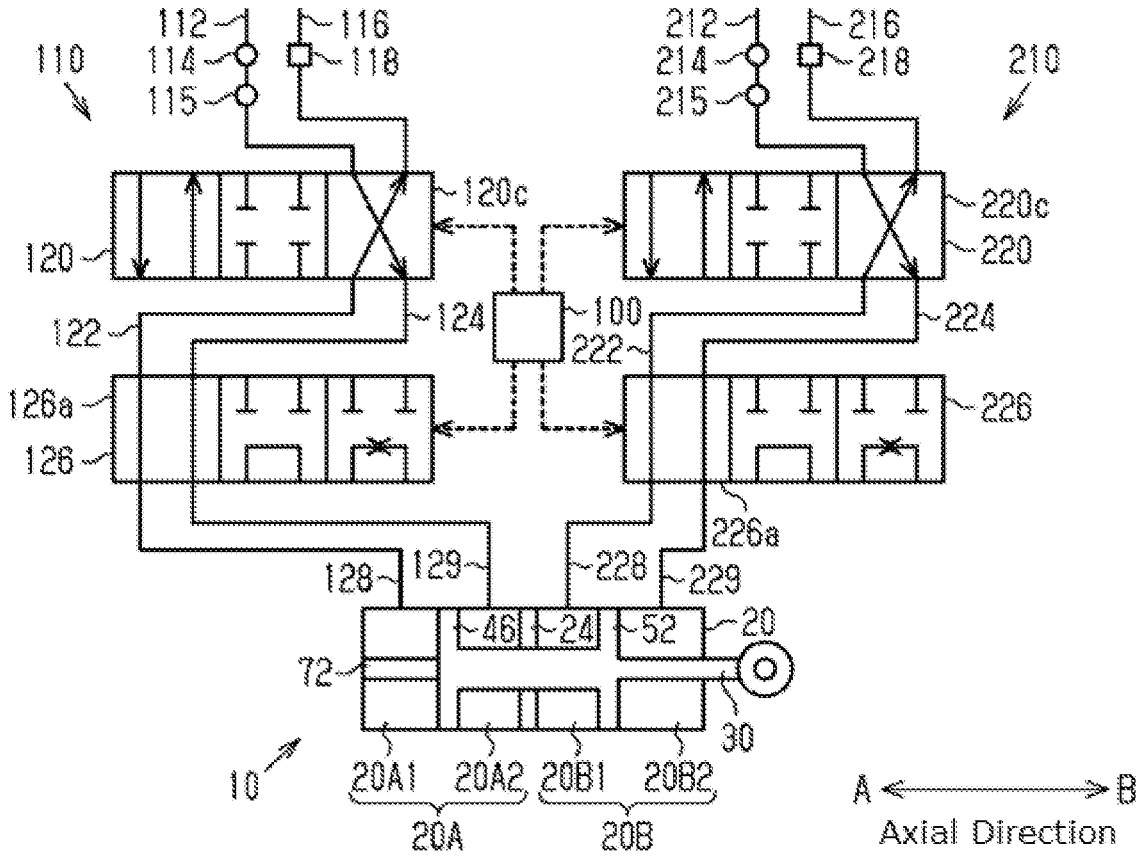
FIG. 3 is a schematic diagram showing the first switching pattern in the fluid actuator system.
Figure 6:
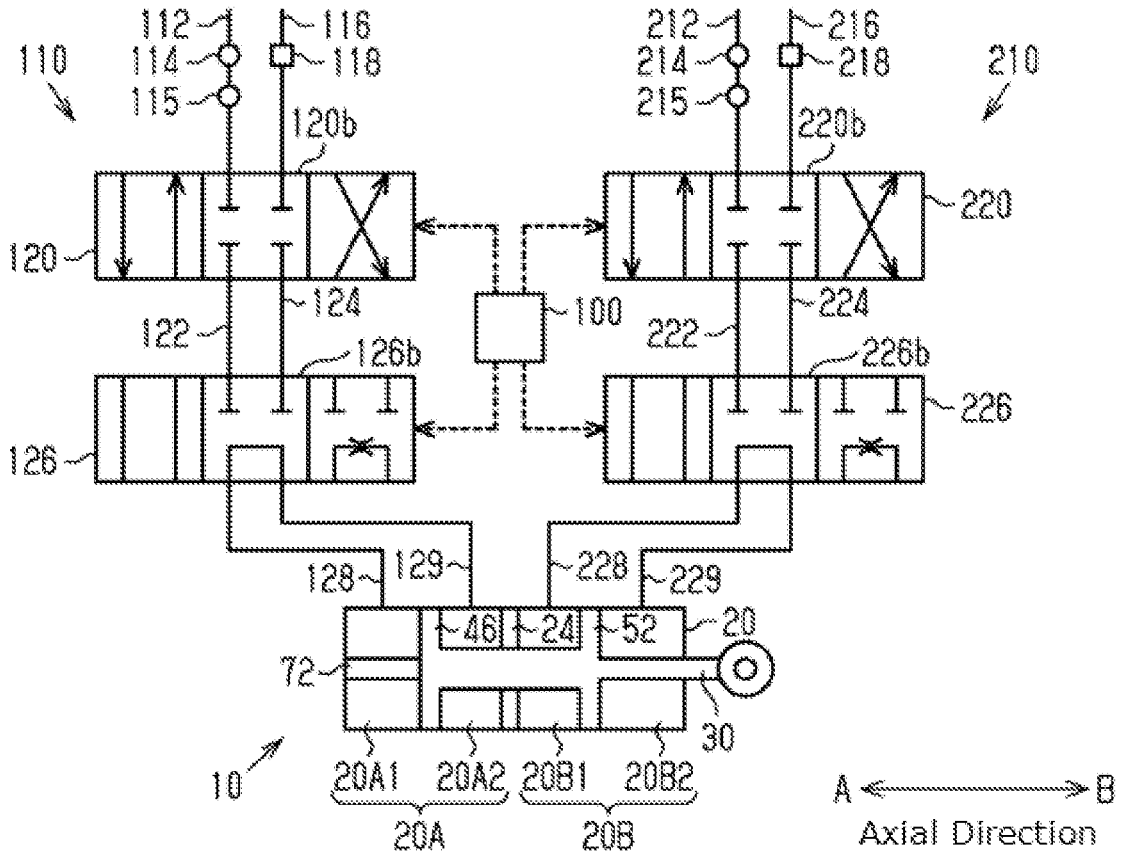
FIG. 6 is a schematic diagram showing a fourth switching pattern in the fluid actuator system.

The first passage switching valve 120 is also connected with a relay passage 122 for the first partition chamber 20A1 and a relay passage 124 for the second partition chamber 20A2, in addition to the first feeding passage 112 and the first discharging passage 116. The first passage switching valve 120 is switched between three positions, a communication position 120*a*, a disconnection position 120*b*, and a reverse communication position 120*c* in response to a drive signal from a controller 100 (described later), so as to control feed and discharge of the hydraulic fluid to and from the first fluid chamber 20A. As shown in FIG. 2, when the first passage switching valve 120 is switched to the communication position 120*a*, the first feeding passage 112 is allowed to communicate with the relay passage 122 for the first partition chamber 20A1, and the first discharging passage 116 is allowed to communicate with the relay passage 124 for the second partition chamber 20A2. As shown in FIG. 3, when the first passage switching valve 120 is switched to the reverse communication position 120*c*, the first feeding passage 112 is allowed to communicate with the relay passage 124 for the second partition chamber 20A2, and the first discharging passage 116 is allowed to communicate with the relay passage 122 for the first partition chamber 20A1. As shown in FIG. 6, when the first passage switching valve 120 is switched to the disconnection position 120*b*, the first feeding passage 112 and the first discharging passage 116 are disconnected from both the relay passage 122 for the first partition chamber 20A1 and the relay passage 124 for the second partition chamber 20A2.

As shown in FIG. 2, the relay passage 122 for the first partition chamber 20A1 is connected, at the opposite side to the first passage switching valve 120, to a first mode switching valve 126 formed of a 3-position 4-port valve. Also, the relay passage 124 for the second partition chamber 20A2 is connected, at the opposite side to the first passage switching valve 120, to the first mode switching valve 126. The first mode switching valve 126 is also connected with a communication passage 128 for the first partition chamber 20A1 and a communication passage 129 for the second partition chamber 20A2, in addition to the relay passages 122, 124. Also, the communication passage 128 for the first partition chamber 20A1 is connected, at the opposite side to the first mode switching valve 126, to the first partition chamber 20A1. The communication passage 129 for the second partition chamber 20A2 is connected, at the opposite side to the first mode switching valve 126, to the second partition chamber 20A2.

The first mode switching valve 126 is switched between three positions, a communication position 126*a*, a normal disconnection position 126*b*, and a damping disconnection position 126*c* in response to a drive signal from the controller 100 (described later), so as to control feed and discharge of the hydraulic fluid to and from the first fluid chamber 20A. As shown in FIG. 2, when the first mode switching valve 126 is switched to the communication position 126*a*, the first mode switching valve 126 enters a normal mode. When the first mode switching valve 126 is switched to the communication position 126*a*, the relay passage 122 for the first partition chamber 20A1 is allowed to communicate with the communication passage 128, and the relay passage 124 for the second partition chamber 20A2 is allowed to communicate with the communication passage 129. As a result, with a medium of the first passage switching valve 120, one of the first partition chamber 20A1 and the second partition chamber 20A2 is allowed to communicate with the first feeding passage 112, and the other is allowed to communicate with the first discharging passage 116.

Figure 7:
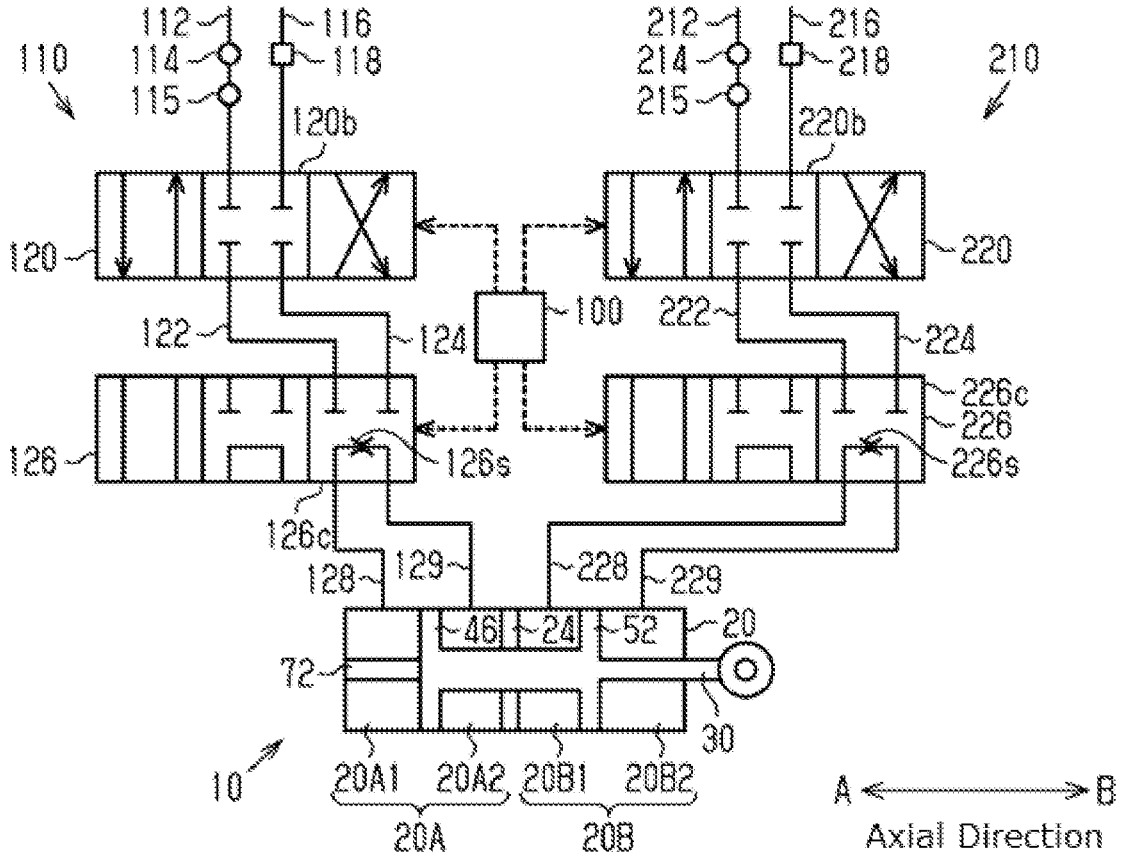
FIG. 7 is a schematic diagram showing a fifth switching pattern in the fluid actuator system.

As shown in FIG. 7, when the first mode switching valve 126 is switched to the damping disconnection position 126*c*, the first mode switching valve 126 enters a damping mode. Specifically, when the first mode switching valve 126 is switched to the damping disconnection position 126*c*, the communication between the relay passage 122 for the first partition chamber 20A1 and the communication passage 128 is disconnected, and the communication between the relay passage 124 for the second partition chamber 20A2 and the communication passage 129 is disconnected. Also, the communication passage 128 for the first partition chamber 20A1 is allowed to communicate with the communication passage 129 for the second partition chamber 20A2 via an orifice 126*s*. Specifically, when the first mode switching valve 126 is switched to the damping disconnection position 126*c*, the channel formed in the first mode switching valve 126 includes a portion having a smaller passage cross-sectional area than other portions and configured to resist the flow of the hydraulic fluid. When the first mode switching valve 126 is switched to the damping disconnection position 126*c*, the first partition chamber 20A1 is allowed to communicate with the second partition chamber 20A2 with a medium of such a resistance.

As shown in FIG. 6, when the first mode switching valve 126 is switched to the normal disconnection position 126*b*, the first mode switching valve 126 enters a free mode. When the first mode switching valve 126 is switched to the normal disconnection position 126*b*, the communication between the relay passage 122 for the first partition chamber 20A1 and the communication passage 128 is disconnected, and the communication between the relay passage 124 for the second partition chamber 20A2 and the communication passage 129 is disconnected. Also, the communication passage 128 for the first partition chamber 20A1 is allowed to communicate with the communication passage 129 for the second partition chamber 20A2 without the medium of an orifice. In other words, when the first mode switching valve 126 is switched to the normal disconnection position 126*b*, the first partition chamber 20A1 is allowed to communicate with the second partition chamber 20A2 without the medium of a resistance.

The communication passages 128, 129, the relay passages 122, 124, the first mode switching valve 126, the first passage switching valve 120, the first feeding passage 112, the first discharging passage 116 constitute a first hydraulic circuit 110. The first hydraulic circuit 110 is contained in the manifold 14.

Next, the channel associated with the second fluid chamber 20B is described. This channel is configured in the same manner as the first fluid chamber 20A. Therefore, this channel is described mainly as to the connection relationship between passages and switching valves, and duplicate description will be omitted as to the details of the operation of these elements.

In the channel associated with the second fluid chamber 20B, the tank is connected with a second feeding passage 212 and a second discharging passage 216. As shown in FIG. 2, a pump 214 and a check valve 215 are installed to the second feeding passage 212. A second compensator 218 is installed to the second discharging passage 216. The second feeding passage 212 and the second discharging passage 216 are connected to a second passage switching valve 220. The second passage switching valve 220 is also connected with a relay passage 222 for the first partition chamber 20B1 and a relay passage 224 for the second partition chamber 20B2. The second passage switching valve 220 is switched between a communication position 220*a*, a disconnection position 220*b*, and a reverse communication position 220*c*. The relay passage 222 for the first partition chamber 20B1 and the relay passage 224 for the second partition chamber 20B2 are connected to a second mode switching valve 226. The second mode switching valve 226 is also connected with a communication passage 228 for the first partition chamber 20B1 and a communication passage 229 for the second partition chamber 20B2. The communication passage 228 for the first partition chamber 20B1 is connected to the first partition chamber 20B1, and the communication passage 229 for the second partition chamber 20B2 is connected to the second partition chamber 20B2. The second mode switching valve 226 is switched between a communication position 226*a*, a normal disconnection position 226*b*, and a damping disconnection position 226*c*. In other words, the second mode switching valve 226 can be switched to any of the normal mode, the damping mode, and the free mode.

The communication passages 228, 229, the relay passages 222, 224, the second mode switching valve 226, the second passage switching valve 220, the second feeding passage 212, the second discharging passage 216 constitute a second hydraulic circuit 210. The second hydraulic circuit 210 is contained in the manifold 14.

Next, a control scheme of the fluid actuator system is described. The controller 100 serving as a control unit controls the first passage switching valve 120, the first mode switching valve 126, the second passage switching valve 220, and the second mode switching valve 226. The controller 100 may be formed of one or more processors that perform various processes in accordance with computer programs (software). Alternatively, the controller 100 may be formed of one or more dedicated hardware circuits such as application-specific integrated circuits (ASICs) that perform at least a part of the various processes, or it may be formed of circuitry including a combination of such circuits. The processor includes a CPU and a memory such as a RAM or a ROM. The memory stores program codes or instructions configured to cause the CPU to perform processes. The memory, or a computer-readable medium, encompasses any kind of available medium accessible to a general-purpose or dedicated computer.

The controller 100 receives sensing signals from a plurality of pressure sensors for monitoring the pressure of the hydraulic fluid in the first hydraulic circuit 110. The controller 100 receives sensing signals from a plurality of pressure sensors for monitoring the pressure of the hydraulic fluid in the second hydraulic circuit 210. Further, the controller 100 receives sensing signals from the differential transformer position sensor 73. The controller 100 calculates the moving speed of the piston rod 30 based on the sensing signals from the differential transformer position sensor 73. Therefore, the differential transformer position sensor 73 operates as a sensing device for sensing the moving speed of the piston rod 30. Further, the controller 100 receives signals related to a plurality of other fluid actuators mounted to the same flap as is the piston rod 30 of the fluid actuator 10. Specifically, the controller 100 receives signals indicating which of the normal mode, the free mode, and the damping mode the mode switching valves associated with the plurality of other fluid actuators are in. The fluid actuator system includes the controller 100, the first hydraulic circuit 110, the second hydraulic circuit 210, and the fluid actuator 10 described above.

Next, a description is given of the control performed by the controller 100 and the operation of the fluid actuator system according to the control. The controller 100 performs the following five switching patterns depending on whether the first hydraulic circuit 110 and the second hydraulic circuit 210 have abnormality.

<First Switching Pattern>

As shown in FIG. 2, when none of the first hydraulic circuit 110 and the second hydraulic circuit 210 has abnormality, the controller 100 performs the first switching pattern in which the first mode switching valve 126 is switched to the communication position 126*a*, the second mode switching valve 226 is switched to the communication position 226*a*, and both are put into the normal mode. In this operation, the controller 100 switches both the first passage switching valve 120 and the second passage switching valve 220 to the respective communication positions or reverse communication positions, based on the sensing signals from the differential transformer position sensor 73.

Specifically, when the position of the piston rod 30 is on the axial direction A side of the cylinder 20 beyond a target position, the controller 100 drives the pump 114 of the first feeding passage 112 and switches the first passage switching valve 120 to the communication position 120*a*. As a result, the first feeding passage 112 is allowed to communicate with the first partition chamber 20A1 of the first fluid chamber 20A, and the first discharging passage 116 is allowed to communicate with the second partition chamber 20A2 of the first fluid chamber 20A. The hydraulic fluid is fed from the first feeding passage 112 to the first partition chamber 20A1 of the first fluid chamber 20A, and the hydraulic fluid is also discharged from the second partition chamber 20A2 of the first fluid chamber 20A to the first discharging passage 116. Also, the controller 100 drives the pump 214 of the second feeding passage 212 and switches the second passage switching valve 220 to the communication position 220*a*. Consequently, as with the first hydraulic circuit 110, the hydraulic fluid is fed from the second feeding passage 212 to the first partition chamber 20B1 of the second fluid chamber 20B, and the hydraulic fluid is also discharged from the second partition chamber 20B2 of the second fluid chamber 20B to the second discharging passage 216. As a result of these operations, the piston rod 30 moves toward the axial direction B side of the cylinder 20.

Conversely, as shown in FIG. 3, when the position of the piston rod 30 is on the axial direction B side of the cylinder 20 beyond the target position, the controller 100 drives the pump 114 of the first feeding passage 112 and switches the first passage switching valve 120 to the reverse communication position 120*c*. As a result, the first feeding passage 112 is allowed to communicate with the second partition chamber 20A2 of the first fluid chamber 20A, and the first discharging passage 116 is allowed to communicate with the first partition chamber 20A1 of the first fluid chamber 20A. As with the first hydraulic circuit 110, the controller 100 also switches the second passage switching valve 220 to the reverse communication position 220*c*, such that the second feeding passage 212 is allowed to communicate with the second partition chamber 20B2 of the second fluid chamber 20B, and the second discharging passage 216 is allowed to communicate with the first partition chamber 20B1 of the second fluid chamber 20B. As a result of these operations, the piston rod 30 moves toward the axial direction A side of the cylinder 20.

When the piston rod 30 reaches the target position as the first passage switching valve 120 is in the communication position 120*a*, the controller 100 stops driving the pump 114 of the first feeding passage 112. At this time, the first compensator 118 is allowed to communicate with the second partition chamber 20A2 of the first fluid chamber 20A. When the hydraulic fluid in the second partition chamber 20A2 is expanded by heat, the first compensator 118 stores the hydraulic fluid, and when the hydraulic fluid is contracted by heat or when the hydraulic fluid is leaking out, the first compensator 118 replenishes the second partition chamber 20A2 with the hydraulic fluid. The first compensator 118 operates in the same manner when the first passage switching valve 120 is in the reverse communication position 120*c*. The second compensator 218 operates in the same manner as the first compensator 118.

<Second Switching Pattern>

Figure 4:
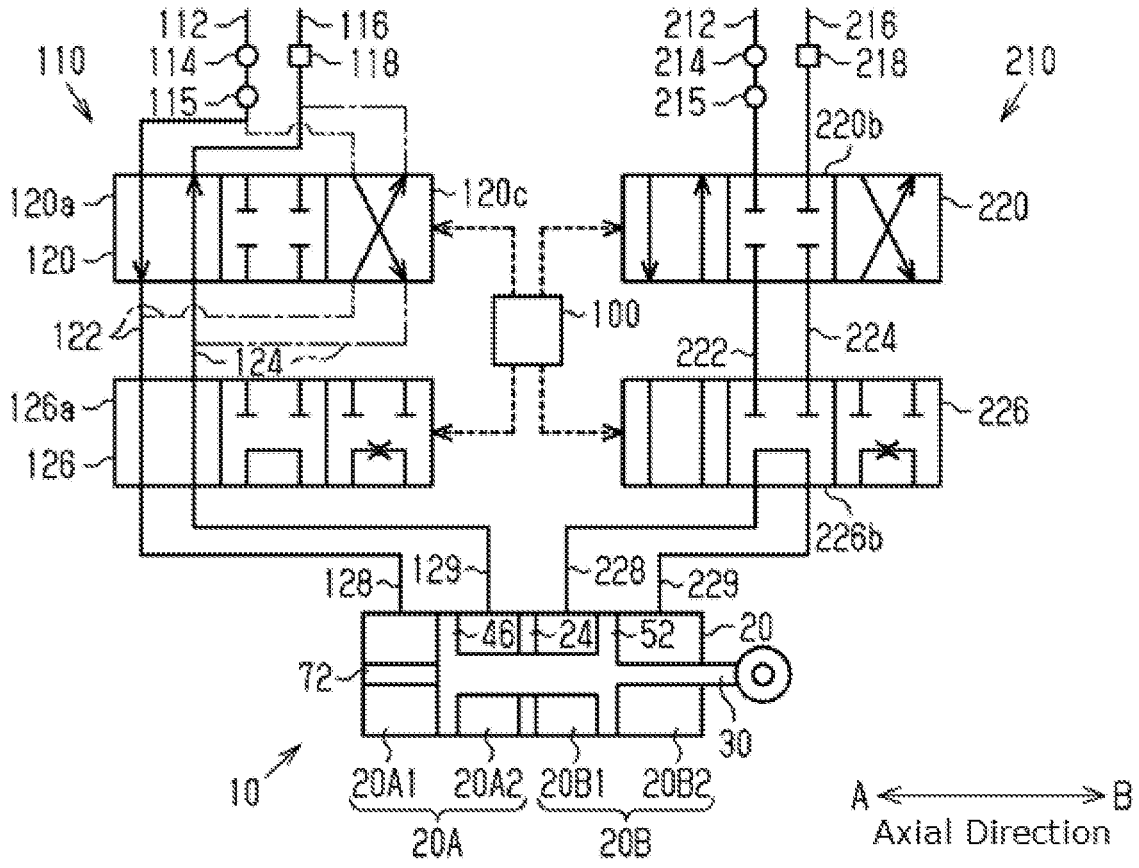
FIG. 4 is a schematic diagram showing a second switching pattern in the fluid actuator system.

As shown in FIG. 4, when the first hydraulic circuit 110 has no abnormality and the second hydraulic circuit 210 has abnormality, the controller 100 performs the second switching pattern in which the first mode switching valve 126 is switched to the communication position 126*a*, and the first mode switching valve 126 is put into the normal mode. The controller 100 also switches the second mode switching valve 226 to the normal disconnection position 226*b* to put the second mode switching valve 226 into the free mode.

In the second switching pattern, the controller 100 switches the second passage switching valve 220 to the disconnection position 220*b*. Since the second mode switching valve 226 has been switched to the normal disconnection position 226*b*, the first partition chamber 20B1 of the second fluid chamber 20B is allowed to communicate with the second partition chamber 20B2. Accordingly, the hydraulic fluid can flow freely between the first partition chamber 20B1 and the second partition chamber 20B2 of the second fluid chamber 20B in both directions.

On the other hand, as with the first switching pattern, the controller 100 switches the first passage switching valve 120 to the communication position 120*a* or the reverse communication position 120*c*, based on the sensing signals from the differential transformer position sensor 73. When the position of the piston rod 30 is on the axial direction A side of the cylinder 20 beyond the target position, the controller 100 switches the first passage switching valve 120 to the communication position 120*a*. In this operation, the first feeding passage 112 is allowed to communicate with the first partition chamber 20A1 of the first fluid chamber 20A, and the first discharging passage 116 is allowed to communicate with the second partition chamber 20A2 of the first fluid chamber 20A. The hydraulic fluid is fed from the first feeding passage 112 to the first partition chamber 20A1 of the first fluid chamber 20A, and the hydraulic fluid is also discharged from the second partition chamber 20A2 of the first fluid chamber 20A to the first discharging passage 116. As a result, the piston rod 30 moves toward the axial direction B side of the cylinder 20. Conversely, when the position of the piston rod 30 is on the axial direction B side of the cylinder 20 beyond the target position, the controller 100 switches the first passage switching valve 120 to the reverse communication position 120*c*, as shown by the dashed-dotted line in FIG. 4. In this operation, the first feeding passage 112 is allowed to communicate with the second partition chamber 20A2 of the first fluid chamber 20A, and the first discharging passage 116 is allowed to communicate with the first partition chamber 20A1 of the first fluid chamber 20A. The hydraulic fluid is fed from the first feeding passage 112 to the second partition chamber 20A2 of the first fluid chamber 20A, and the hydraulic fluid is also discharged from the first partition chamber 20A1 of the first fluid chamber 20A to the first discharging passage 116. As a result, the piston rod 30 moves toward the axial direction A side of the cylinder 20.

<Third Switching Pattern>

Figure 5:
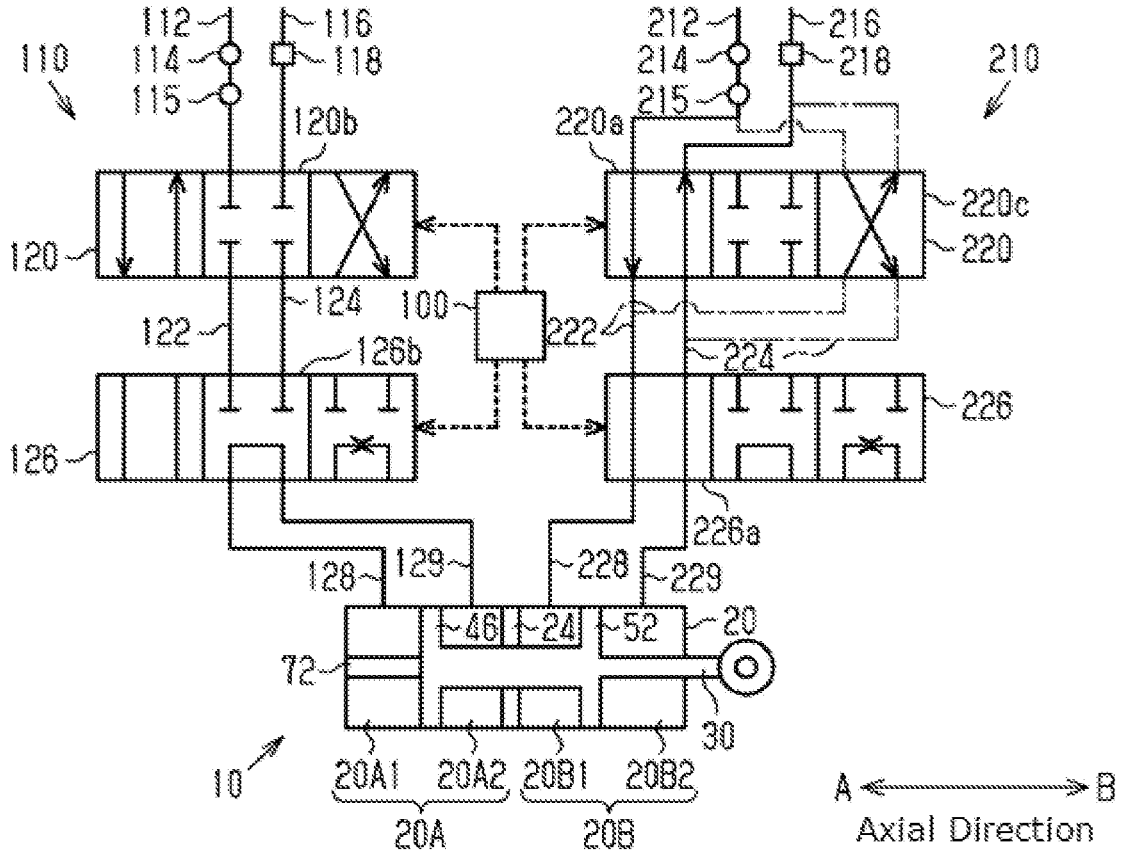
FIG. 5 is a schematic diagram showing a third switching pattern in the fluid actuator system.

As shown in FIG. 5, when the second hydraulic circuit 210 has no abnormality and the first hydraulic circuit 110 has abnormality, the controller 100 performs the third switching pattern in which the second mode switching valve 226 is switched to the communication position 226*a*, and the second mode switching valve 226 is put into the normal mode. The controller 100 also switches the first mode switching valve 126 to the normal disconnection position 126*b* to put the first mode switching valve 126 into the free mode.

In the third switching pattern, the controller 100 switches the first passage switching valve 120 to the disconnection position 120*b*. Since the first mode switching valve 126 has been switched to the normal disconnection position 126*b*, the first partition chamber 20A1 of the first fluid chamber 20A is allowed to communicate with the second partition chamber 20A2. Accordingly, the hydraulic fluid can flow freely between the first partition chamber 20A1 and the second partition chamber 20A2 of the first fluid chamber 20A in both directions.

On the other hand, as with the first switching pattern, the controller 100 switches the second passage switching valve 220 to the communication position 220*a* or the reverse communication position 220*c*, based on the sensing signals from the differential transformer position sensor 73. When the position of the piston rod 30 is on the axial direction A side of the cylinder 20 beyond the target position, the controller 100 switches the second passage switching valve 220 to the communication position 220*a*. In this operation, the second feeding passage 212 is allowed to communicate with the first partition chamber 20B1 of the second fluid chamber 20B, and the second discharging passage 216 is allowed to communicate with the second partition chamber 20B2 of the second fluid chamber 20B. The hydraulic fluid is fed from the second feeding passage 212 to the first partition chamber 20B1 of the second fluid chamber 20B, and the hydraulic fluid is also discharged from the second partition chamber 20B2 of the second fluid chamber 20B to the second discharging passage 216. As a result, the piston rod 30 moves toward the axial direction B side of the cylinder 20. Conversely, when the position of the piston rod 30 is on the axial direction B side of the cylinder 20 beyond the target position, the controller 100 switches the second passage switching valve 220 to the reverse communication position 220*c*, as shown by the dashed-dotted line in FIG. 5. In this operation, the second feeding passage 212 is allowed to communicate with the second partition chamber 20B2 of the second fluid chamber 20B, and the second discharging passage 216 is allowed to communicate with the first partition chamber 20B1 of the second fluid chamber 20B. The hydraulic fluid is fed from the second feeding passage 212 to the second partition chamber 20B2 of the second fluid chamber 20B, and the hydraulic fluid is also discharged from the first partition chamber 20B1 of the second fluid chamber 20B to the second discharging passage 216. As a result, the piston rod 30 moves toward the axial direction A side of the cylinder 20.

<Fourth Switching Pattern>

As shown in FIG. 6, the controller 100 performs the fourth switching pattern when both the first hydraulic circuit 110 and the second hydraulic circuit 210 have abnormality in the pressure of the hydraulic fluid and at least one of the other fluid actuators mounted to the same flap as is the fluid actuator 10 has a mode switching valve thereof switched to the normal mode. In the fourth switching pattern, the controller 100 switches the first mode switching valve 126 to the normal disconnection position 126*b* and switches the second mode switching valve 226 to the normal disconnection position 226*b*. That is, the controller 100 switches both the first mode switching valve 126 and the second mode switching valve 226 to the free mode. In the fourth switching pattern, the controller 100 switches the first passage switching valve 120 to the disconnection position 120*b* and switches the second passage switching valve 220 to the disconnection position 220*b*. Therefore, in the fourth switching pattern, the first partition chamber 20A1 of the first fluid chamber 20A is allowed to communicate with the second partition chamber 20A2, and the first partition chamber 20B1 of the second fluid chamber 20B is allowed to communicate with the second partition chamber 20B2. Accordingly, the hydraulic fluid can flow freely between the first partition chamber 20A1 and the second partition chamber 20A2 of the first fluid chamber 20A in both directions. Also, the hydraulic fluid can flow freely between the first partition chamber 20B1 and the second partition chamber 20B2 of the second fluid chamber 20B in both directions. As a result, the piston rod 30 can move under no resistance in accordance with movement of the flap being actuated by other fluid actuators.

<Fifth Switching Pattern>

As shown in FIG. 7, the controller 100 performs the fifth switching pattern when both the first hydraulic circuit 110 and the second hydraulic circuit 210 have abnormality in the pressure of the hydraulic fluid and none of the other fluid actuators mounted to the same flap as is the fluid actuator 10 has a mode switching valve thereof switched to the normal mode. In the fifth switching pattern, the controller 100 switches the first mode switching valve 126 to the damping disconnection position 126*c* and switches the second mode switching valve 226 to the damping disconnection position 226*c*. That is, the controller 100 switches both the first mode switching valve 126 and the second mode switching valve 226 to the damping mode. In the fifth switching pattern, the controller 100 switches the first passage switching valve 120 to the disconnection position 120*b* and switches the second passage switching valve 220 to the disconnection position 220*b*. Therefore, in the fifth switching pattern, the first partition chamber 20A1 of the first fluid chamber 20A is allowed to communicate with the second partition chamber 20A2 via the orifice 126*s*, and the first partition chamber 20B1 of the second fluid chamber 20B is allowed to communicate with the second partition chamber 20B2 via the orifice 226*s*. Accordingly, the hydraulic fluid flows under resistance between the first partition chamber 20A1 and the second partition chamber 20A2 of the first fluid chamber 20A in both directions. Also, the hydraulic fluid flows under resistance between the first partition chamber 20B1 and the second partition chamber 20B2 of the second fluid chamber 20B in both directions. Therefore, the piston rod 30 moves under resistance when the flap to which it is mounted is moved. As the fifth switching pattern is continued, the movement of the flap is gradually damped.

When performing any of the first to fourth switching patterns, the controller 100 proceeds to the fifth switching pattern upon sensing that the piston rod 30 has been reciprocating at a speed equal to or greater than a prescribed speed for a period equal to or greater than a prescribed amount of time, based on the sensing result of the differential transformer position sensor 73. That is, the controller 100 switches both the first mode switching valve 126 and the second mode switching valve 226 to the damping mode.

When the flap is oscillating at a relatively high speed during a flight of an aircraft, the flight condition of the airframe may turn instable. The above prescribed speed and the prescribed amount of time are determined previously by experiments or otherwise as values at which the flap can be stopped from oscillating before the flight condition of the airframe turns instable.

Advantageous effects of the embodiment will be now described.

(1) As to Materials of the Fluid Actuator 10

A high rigidity is required in the vicinity of the first mounting portion 22*z* in the cylinder 20, so as to withstand impacts acting from the airframe onto the first mounting portion 22*z*. In addition, in the cylinder 20, a pressure produced by movement of the piston rod 30 tends to act on the wall portions positioned on the central axis of the cylinder 20 such as the end wall 22*a* of the first cylinder unit 22 and the second cylinder unit 24. Therefore, a high rigidity is required in these portions. Because of these circumstances, in this embodiment, the first cylinder unit 22, the second cylinder unit 24, and the fourth cylinder unit 28 are made of a highly rigid member such as stainless steel or bronze. Stainless steel and bronze have a high specific weight. Therefore, if the cylinder 20 as a whole is made of stainless steel or bronze, the fluid actuator 10 has a large weight. With this respect, in this embodiment, the third cylinder unit 26 is made of an aluminum alloy. The third cylinder unit 26 defines the radially outer side of the second fluid chamber 20B. Since the wall portion defining the radially outer side of the second fluid chamber 20B receives less pressure produced by the reciprocation of the piston rod 30, this wall portion is not required to have as high rigidity as the wall portions positioned on the axis of the cylinder 20. In addition, since the second fluid chamber 20B is spaced from the first mounting portion 22*z* toward the axial direction B side, the second fluid chamber 20B is not required to have as high rigidity as the vicinity of the first mounting portion 22*z*. Therefore, the third cylinder unit 26 can be made of an aluminum alloy having a small weight. Since the third cylinder unit 26 is made of an aluminum alloy, the weight of the cylinder 20 can be reduced. Further, in this embodiment, the manifold 14 mounted to the cylinder 20 is also made of an aluminum alloy. In this way, a part of the cylinder 20 and the manifold 14 are made of an aluminum alloy, thus reducing the weight of the fluid actuator 10.

(2) As to the Connection Between the Cylinder 20 and the Manifold 14

(2-1) As to the Pipes 16

In the configuration of the embodiment, the pipes 16 connect the hydraulic circuits contained in the manifold 14 to the fluid chambers in the cylinder 20. Since the pipes 16 connect the hydraulic circuits to the fluid chambers, it is not necessary that the manifold is extended to such positions in the cylinder 20 as those of the ports P communicating with the first fluid chamber 20A, for example. Therefore, the manifold 14 can be downsized.

(2-2) As to the Hydraulic Circuits Contained in the Manifold 14

Since the manifold 14 is mounted integrally on the outer peripheral surface of the cylinder 20, the manifold 14 is positioned relatively close to the first fluid chamber 20A and the second fluid chamber 20B. Since the hydraulic circuits, which have the passage switching valves and the mode switching valves, are contained in the manifold 14, the pipes 16 connecting the hydraulic circuits to the fluid chambers can be short.

(3) As to the Seal Member S Mounted in the Retaining Groove 42*a* of the First Piston Unit 40

In the fluid actuator disclosed in the '642 Patent, a fluid chamber having a columnar shape is defined within a cylinder. A guide member projects from a bottom portion of the cylinder on the one axial direction side thereof. A piston rod is inserted through another bottom portion of the cylinder on the other axial direction side thereof. The piston rod has an opening in an end portion thereof on the one axial direction side. The guide member is inserted in the piston rod through the opening. The piston rod reciprocates along the guide member. A seal member is mounted on the outer peripheral surface of the guide member to block the gap between the guide member and the piston rod. The seal member is positioned on an end portion of the guide member on the other axial direction side. In the fluid actuator disclosed in the '642 Patent, when the piston rod moves to a position at a certain distance from the seal member toward the one axial direction side of the cylinder, a gap is produced between the piston rod and the guide member on the one axial direction side beyond the seal member. Since the fluid enters such a gap, the volume of the fluid chamber enlarges by the gap and thus is different from a desired volume. The difference of the volume produces an error in the output for moving the piston rod. With this respect, in the embodiment, the seal member S is mounted in the end portion of the large diameter portion 42 on the axial direction A side. That is, the seal member S is mounted in the piston rod 30 that is a moving member, instead of the guide member 72 that is an immobilized member. Therefore, the seal member S moves along with the end portion of the large diameter portion 42 on the axial direction A side. As a result, since the seal member S moves in accordance with the position of the end portion of the large diameter portion 42 on the axial direction A side, the end portion of the large diameter portion 42 on the axial direction A side can block the gap between the first piston unit 40 and the guide member 72, irrespective of the position of the piston rod 30 reciprocating. Since the end portion of the large diameter portion 42 on the axial direction A side can block the gap between the first piston unit 40 and the guide member 72, the volume of the first partition chamber 20A1 in the first fluid chamber 20A can be maintained to be substantially equal to the volume of the second partition chamber 20B2 in the second fluid chamber 20B.

(4) As to the Structure of the Piston Rod 30

In the fluid actuator disclosed in the '642 Patent, a fluid chamber is defined within a cylinder. The cylinder receives a piston rod therein. Variation of the pressure of the fluid fed into the fluid chamber causes the piston rod to reciprocate. An object to be oscillated is mounted to the piston rod. In the fluid actuator disclosed in the '642 Patent, the piston rod is required to have such a durability as to withstand repeated reciprocation with the object to be oscillated mounted thereto. By way of an example, a metal part will fatigue and lose its strength after repeated compression and tension, while it is less likely to fatigue when compression or tension is continued. In the embodiment, the cylindrical member 51 of the second piston unit 50 is compressed between the piston end 60 and the step surface 40*a* of the first piston unit 40. Since the piston end 60 and the first piston unit 40 are threadably engaged with each other, the cylindrical member 51 is maintained to be compressed. Accordingly, the cylindrical member 51 is less likely to fatigue and thus has a reinforced fatigue strength. On the other hand, since the piston end 60 and the step surface 40*a* of the first piston unit 40 compress the first piston unit 40 interposed therebetween, the piston end 60 is pressed by the cylindrical member 51 in the direction away from the step surface 40*a* of the first piston unit 40, or toward the axial direction B side of the cylinder 20. The small diameter portion 44 of the first piston unit 40 is threadably engaged with the piston end 60. As a result, the small diameter portion 44 of the first piston unit 40 is maintained to be pulled in the direction away from the step surface 40*a*. Accordingly, the small diameter portion 44 is less likely to fatigue and thus has a reinforced fatigue strength. As a result of such arrangement, the piston rod 30 as a whole has a reinforced fatigue strength.

(5) As to the Orthogonal Cross-Sectional Areas of the Fluid Chambers

When both the first mode switching valve 126 and the second mode switching valve 226 are in the free mode, the piston rod 30 moves in accordance with the movement of the flap. At a moment when the piston rod 30 moves in accordance with the movement of the flap, the piston rod 30 will move with substantially no hydraulic fluid flowing into or out of the first partition chamber 20A1 and the second partition chamber 20A2 of the first fluid chamber 20A. Also, the piston rod 30 will move with substantially no hydraulic fluid flowing into or out of the first partition chamber 20B1 and the second partition chamber 20B2 of the second fluid chamber 20B. For the first fluid chamber 20A, the orthogonal cross-sectional area of the first partition chamber 20A1 is larger than that of the second partition chamber 20A2. Therefore, when the first piston 46 is positioned at substantially the axial middle of the first fluid chamber 20A, the volume of the first partition chamber 20A1 is larger than that of the second partition chamber 20A2. In this configuration, when substantially no hydraulic fluid flows into or out of the first partition chamber 20A1 and the second partition chamber 20A2, a force acts on the first piston 46 in the direction described as follows. The force acts from the first partition chamber 20A1 having the larger volume produced by the larger orthogonal cross-sectional area toward the second partition chamber 20A2 having the smaller volume produced by the smaller orthogonal cross-sectional area. For the second fluid chamber 20B, the orthogonal cross-sectional area of the second partition chamber 20B2 is larger than that of the first partition chamber 20B1. Therefore, conversely to the first fluid chamber 20A, a force acts on the second piston 52 from the second partition chamber 20B2 toward the first partition chamber 20B1. In this way, the piston rod 30 receives from both sides the forces acting toward the axial middle of the cylinder 20, and therefore, the piston rod 30 is not allowed to move in any of the axial direction A side and the axial direction B side of the cylinder 20 and thus is easily retained in the position around the middle of the cylinder 20. This is favorable in avoiding a large oscillation of the flap.

(6) As to the Hydraulic Circuits (6-1) As to the Hydraulic Circuits Each Associated with a Different Fluid Chamber In the fluid actuator disclosed in the '642 Patent, a fluid chamber having a columnar shape is defined within a cylinder. The fluid chamber is partitioned into two fluid chambers at the axial middle of the cylinder. The cylinder receives a piston rod therein. Two pistons project from the piston rod in the radially outward direction. One of the two pistons partitions the fluid chamber on the one axial direction side of the cylinder into two chambers. The other of the two pistons partitions the fluid chamber on the other axial direction side of the cylinder into two chambers. In the fluid actuator disclosed in the '642 Patent, the two chambers in the fluid chamber on one side are each connected to a different connection passage for feeding and discharging the hydraulic fluid. These connection passages are connected to a switching valve for switching the feeding and discharging operations of the hydraulic fluid for one and the other of the two chambers. These connection passages are branched and also connected to the two chambers in the fluid chamber on the other side. In this way, in the technique disclosed in the '642 Patent, a single switching valve switches the feeding and discharging operations of the hydraulic fluid for both of the fluid chamber on one side and the fluid chamber on the other side. In this configuration, a malfunction of the switching valve inhibits the feeding and discharging operations of the hydraulic fluid for both of the fluid chamber on one side and the fluid chamber on the other side, possibly resulting in a failure of the fluid actuator. With this respect, in the embodiment, each of the first fluid chamber 20A and the second fluid chamber 20B is provided with a dedicated hydraulic circuit and provided with a dedicated passage switching valve and a dedicated mode switching valve. Therefore, even when abnormality occurs in any one of the hydraulic circuits associated with the first fluid chamber 20A and the second fluid chamber 20B, the other hydraulic circuit can be used to feed the hydraulic fluid from a feeding passage into a fluid chamber and discharge the hydraulic fluid from a fluid chamber into a discharging passage. Accordingly, a failure of the fluid actuator 10 can be prevented.

(6-2) As to the Mode Switching Valves Each Associated with a Different Fluid Chamber In the fluid actuator disclosed in the '642 Patent, a fluid chamber having a columnar shape is defined within a cylinder. The fluid chamber is partitioned into two fluid chambers at the axial middle of the cylinder. The cylinder receives a piston rod therein. Two pistons project from the piston rod in the radially outward direction. One of the two pistons partitions the fluid chamber on the one axial direction side of the cylinder into two chambers. The other of the two pistons partitions the fluid chamber on the other axial direction side of the cylinder into two chambers. In the fluid actuator disclosed in the '642 Patent, the two chambers in the fluid chamber on one side are each connected to a different connection passage for feeding and discharging the hydraulic fluid. These connection passages are connected to a switching valve for switching the feeding and discharging modes of the hydraulic fluid for the two chambers. This switching valve can switch between a first mode and a second mode. In the first mode, the hydraulic fluid is fed from a source of the hydraulic fluid, while in the second mode, the two chambers are connected to each other and the hydraulic fluid is fed and discharged between the two chambers. When the switching valve is switched to the second mode, the channel formed in the switching valve includes an orifice to damp the flow of the hydraulic fluid, and thus the movement of the piston rod. The above connection passages are branched and also connected to the two chambers in the fluid chamber on the other side. In this way, in the technique disclosed in the '642 Patent, a single switching valve switches the feeding and discharging modes of the hydraulic fluid for both of the fluid chamber on one side and the fluid chamber on the other side. In this configuration, a malfunction of the switching valve inhibits use of the second mode, and thus a resistance cannot be applied to the flow of the hydraulic fluid in any of the fluid chamber on one side and the fluid chamber on the other side. Therefore, the movement of the piston rod probably cannot be damped. With this respect, in the embodiment, each of the first fluid chamber 20A and the second fluid chamber 20B is provided with a dedicated mode switching valve. Therefore, even when abnormality occurs in any one of the mode switching valves associated with the first fluid chamber 20A and the second fluid chamber 20B, the other mode switching valve associated with the other can be used to perform the damping mode. Accordingly, it can be avoided that the movement of the piston rod cannot be damped.

(6-3) As to Control Related to the Damping Mode

In the fluid actuator disclosed in the '642 Patent, a fluid chamber is defined within a cylinder. The cylinder receives a piston rod therein. Variation of the pressure of the fluid fed into the fluid chamber causes the piston rod to reciprocate. In the fluid actuator disclosed in the '642 Patent, the piston rod may reciprocate in accordance with the movement of a mating object mounted to the piston rod. In some cases, it is required to damp such reciprocation of the piston rod. For example, suppose that the fluid actuator is installed in an aircraft and a flap is mounted to the piston rod. When the flap is oscillating at a relatively high speed during a flight of the aircraft, the flight condition of the airframe may turn instable. Therefore, when the oscillation of the flap at a relatively high speed has been continued for a certain amount of time, the oscillation of the flap must be stopped before the flight condition of the airframe turns instable.

With this respect, in the embodiment, when it is sensed that the piston rod 30 has been reciprocating at a speed equal to or greater than a prescribed speed for a period equal to or greater than a prescribed amount of time, both the first mode switching valve 126 and the second mode switching valve 226 are switched to the damping mode. Therefore, the reciprocation of the piston rod 30, or the oscillation of the flap can be damped rapidly before the flight condition of the airframe turns instable.

The foregoing embodiment can be modified as described below. The above embodiment and the following modifications can be implemented in combination to the extent where they are technically consistent with each other.

The configuration of the hydraulic circuits can be modified. For example, it is possible to provide a plurality of orifices 126*s* in the channel formed in the first mode switching valve 126 when the first mode switching valve 126 is switched to the damping disconnection position 126*c*. In this case, even when one of the orifices 126*s* is no longer serving as a resistance due to breakage or otherwise, the other orifices 126*s* can apply resistance to the channel.

Figure 8:
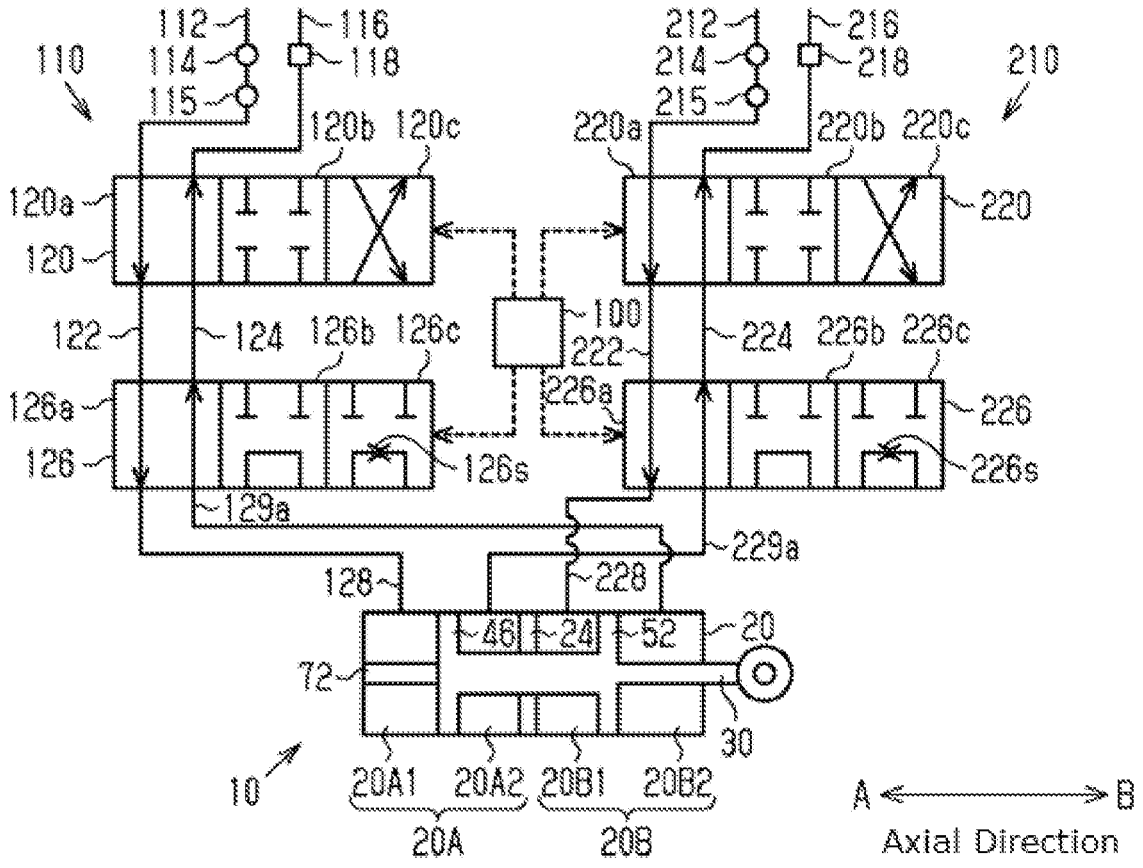
FIG. 8 is a schematic diagram showing a modification of a hydraulic circuit.

It is also possible to change the pair of the partition chambers to and from which the hydraulic fluid is fed and discharged via the first feeding passage 112 and the first discharging passage 116. Along with this change, it is also possible to change the pair of the partition chambers to and from which the hydraulic fluid is fed and discharged via the second feeding passage 212 and the second discharging passage 216. Specifically, as shown in FIG. 8, the first partition chamber 20A1 of the first fluid chamber 20A and the second partition chamber 20B2 of the second fluid chamber 20B may be paired as partition chambers to and from which the hydraulic fluid is fed and discharged via the first feeding passage 112 and the first discharging passage 116. In this case, the communication passage 128, which is one of the communication passages connected to the first mode switching valve 126, is connected to the first partition chamber 20A1 of the first fluid chamber 20A, and the communication passage 129*a*, which is the other, is connected to the second partition chamber 20B2 of the second fluid chamber 20B. In addition, the second partition chamber 20A2 of the first fluid chamber 20A and the first partition chamber 20B1 of the second fluid chamber 20B may be paired as partition chambers to and from which the hydraulic fluid is fed and discharged via the second feeding passage 212 and the second discharging passage 216. Specifically, the communication passage 228, which is one of the communication passages connected to the second mode switching valve 226, is connected to the first partition chamber 20B1 of the second fluid chamber 20B, and the communication passage 229*a*, which is the other, is connected to the second partition chamber 20A2 of the first fluid chamber 20A.

When the partition chambers are paired as described above, the first passage switching valve 120 and the second passage switching valve 220 are controlled such that the communication between the first partition chamber 20A1 of the first fluid chamber 20A and the first feeding passage 112 is concurrent with the communication between the first partition chamber 20B1 of the second fluid chamber 20B and the second feeding passage 212. In addition, the first passage switching valve 120 and the second passage switching valve 220 are controlled such that the communication between the second partition chamber 20A2 of the first fluid chamber 20A and the second feeding passage 212 is concurrent with the communication between the second partition chamber 20B2 of the second fluid chamber 20B and the first feeding passage 112.

In the fluid actuator disclosed in the '642 Patent, a fluid chamber having a columnar shape is defined within a cylinder. The fluid chamber is partitioned into two fluid chambers at the axial middle of the cylinder. The cylinder receives a piston rod therein. Two pistons project from the piston rod in the radially outward direction. One of the two pistons partitions the fluid chamber on the one axial direction side of the cylinder into two chambers. The other of the two pistons partitions the fluid chamber on the other axial direction side of the cylinder into two chambers. In the fluid actuator disclosed in the '642 Patent, the two chambers in the fluid chamber on one side are each connected to a different connection passage for feeding and discharging the hydraulic fluid. These connection passages are connected to a switching valve for switching the feeding and discharging operations of the hydraulic fluid for one and the other of the two chambers. These connection passages are branched and also connected to the two chambers in the fluid chamber on the other side.

In the technique disclosed in the '642 Patent, a single switching valve switches the feeding and discharging operations of the hydraulic fluid for both of the fluid chamber on one side and the fluid chamber on the other side. In this configuration, a malfunction of the switching valve inhibits the feeding and discharging operations of the hydraulic fluid for both of the fluid chamber on one side and the fluid chamber on the other side, possibly resulting in a failure of the fluid actuator. To overcome this problem, it is possible to provide a plurality of switching valves. When a plurality of switching valves are provided, it is required to substantially equalize, for each switching valve, the amount of the hydraulic fluid fed via the switching valve to the amount of the hydraulic fluid discharged via the switching valve.

In the configuration shown in FIG. 8, the first partition chamber 20A1 of the first fluid chamber 20A and the second partition chamber 20B2 of the second fluid chamber 20B, which constitute one of the two pairs of the partition chambers, have the same orthogonal cross-sectional area. Therefore, the amount of the hydraulic fluid fed from the first feeding passage 112 to one of these partition chambers is the same as the amount of the hydraulic fluid discharged from the other of these partition chambers to the first discharging passage 116. Whichever partition chamber is communicated with the first discharging passage 116 to discharge the hydraulic fluid to the first discharging passage 116, the amount of discharged hydraulic fluid is the same. Accordingly, it can be prevented that the amount of the hydraulic fluid stored in the first compensator 118 varies in accordance with the movement of the piston rod 30. In this way, since the amount of the hydraulic fluid stored in the first compensator 118 remains substantially constant, the first compensator 118 can contain a storage chamber having a volume corresponding to the constant amount. Therefore, an optimal size can be selected for the first compensator 118 provided on the first discharging passage 116, and the first compensator 118 need not expand.

Likewise, the second partition chamber 20A2 of the first fluid chamber 20A and the first partition chamber 20B1 of the second fluid chamber 20B, which constitute the other of the two pairs of the partition chambers, have the same orthogonal cross-sectional area. Accordingly, as with the above pair, it can be prevented that the amount of the hydraulic fluid stored in the second compensator 218 varies in accordance with the movement of the piston rod 30.

Figure 9:
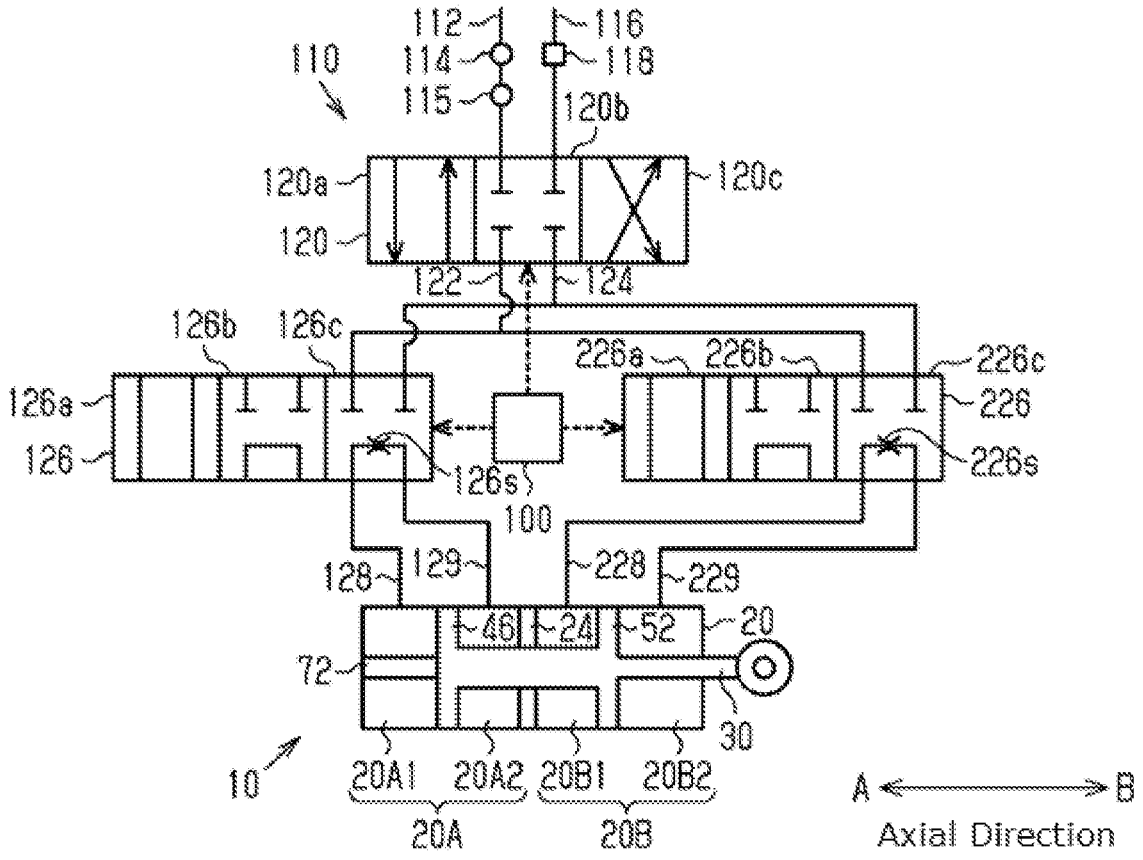
FIG. 9 is a schematic diagram showing a modification of the hydraulic circuit.

Another example of modification to the hydraulic circuits is shown in FIG. 9. In this example, the second passage switching valve 220 is omitted, and the first passage switching valve 120 is connected to both the first mode switching valve 126 and the second mode switching valve 226. In other words, the first passage switching valve 120 is used to switch the feeding and discharging operations of the hydraulic fluid for both the first fluid chamber 20A and the second fluid chamber 20B. In this case, the first feeding passage 112 and the first discharging passage 116 are also used for both the first fluid chamber 20A and the second fluid chamber 20B. In such configuration, as shown in FIG. 9, each of the relay passages 122, 124 connected to the first passage switching valve 120 is branched and connected to both the first mode switching valve 126 and the second mode switching valve 226. In such configuration, each of the first fluid chamber 20A and the second fluid chamber 20B is provided with a dedicated mode switching valve. Therefore, even when abnormality occurs in any one of the mode switching valves associated with the first fluid chamber 20A and the second fluid chamber 20B, the other mode switching valve associated with the other can be used to perform the damping mode.

Figure 10:
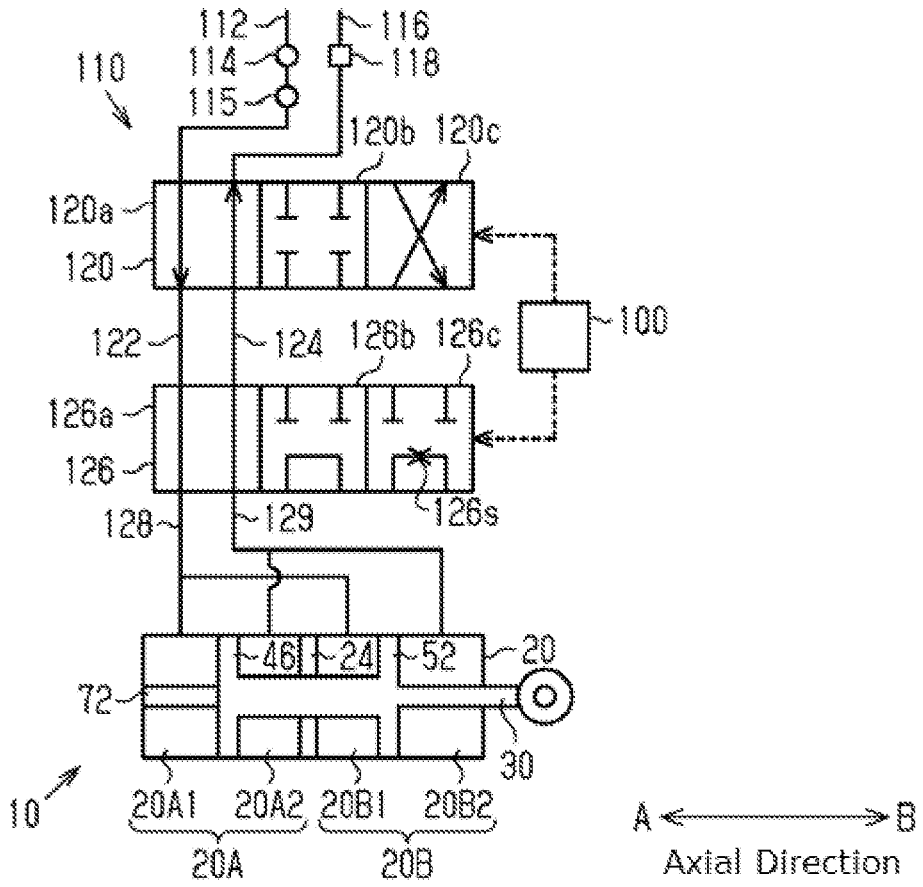
FIG. 10 is a schematic diagram showing a modification of the hydraulic circuit.

Another example of modification to the hydraulic circuits is shown in FIG. 10. In this example, the first hydraulic circuit 110 as a whole is used for both the first fluid chamber 20A and the second fluid chamber 20B. In other words, not only the first passage switching valve 120 but also the first mode switching valve 126 is used for switching the channels of the hydraulic fluid for both the first fluid chamber 20A and the second fluid chamber 20B. In this case, the communication passage 128 connecting between the first mode switching valve 126 and the first partition chamber 20A1 of the first fluid chamber 20A is branched and connected to the first partition chamber 20B1 of the second fluid chamber 20B. Also, the communication passage 129 connecting between the first mode switching valve 126 and the second partition chamber 20A2 of the first fluid chamber 20A is branched and connected to the second partition chamber 20B2 of the second fluid chamber 20B. When the first hydraulic circuit 110 is used for both fluid chambers in this manner, the manifold 14 can be downsized by the size of the second hydraulic circuit 210 omitted, making the manifold 14 more compact.

The condition related to the prescribed amount of time may be eliminated for switching the channel to the fifth switching pattern from any one of the first to fourth switching patterns based on the sensing result of the differential transformer position sensor 73. Specifically, the first mode switching valve 126 and the second mode switching valve 226 may be switched to the damping mode immediately when it is sensed that the moving speed of the piston rod 30 is equal to or greater than the prescribed speed. For example, to damp the movement of the piston rod 30 when the piston rod 30 moves excessively fast to an abnormal degree, it is effective that the damping mode is performed with only the condition related to the prescribed speed. The value of the prescribed speed can be set appropriately in accordance with the application of the damping mode.

The sensing device for sensing the moving speed of the piston rod 30 in the fluid actuator 10 is not limited to the example in the embodiment. Another example of the sensing device is a camera for monitoring the movement of the flap. The moving speed of the piston rod 30 can be calculated based on the moving speed of the flap captured by the camera.

Figure 11:
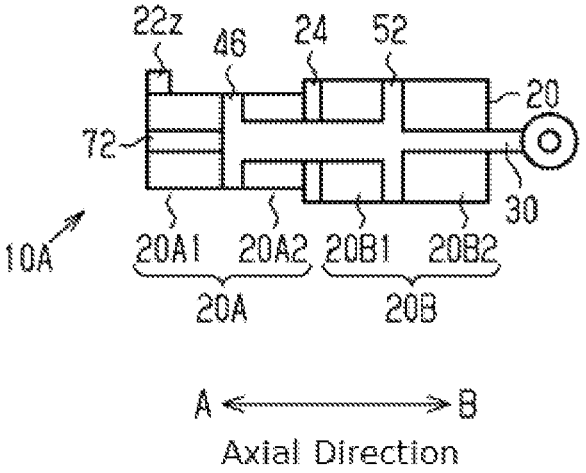
FIG. 11 is a schematic diagram showing a modification of the fluid actuator.

The configuration of the fluid actuator 10 can be modified. For example, it is possible that the outer diameter of the cylinder 20 in the axial direction A side is different from that in the axial direction B side. In the fluid actuator 10A shown in FIG. 11, the outer diameter of the cylinder 20 in the axial direction A side is smaller than that in the axial direction B side. In addition, the maximum value of the orthogonal cross-sectional area in the first fluid chamber 20A, or the orthogonal cross-sectional area of the first partition chamber 20A1 having the larger orthogonal cross-sectional area among the two partition chambers, is smaller than the maximum value of the orthogonal cross-sectional area in the second fluid chamber 20B, or the orthogonal cross-sectional area of the second partition chamber 20B2 having the larger orthogonal cross-sectional area among the two partition chambers.

In the fluid actuator disclosed in the '642 Patent, a fluid chamber having a columnar shape is defined within a cylinder. The cylinder receives a piston rod that reciprocates in the cylinder. On an end portion of the cylinder on the one axial direction side thereof, there is provided a mounting portion for mounting an external object to the cylinder. In a technique like the fluid actuator of the '642 Patent having the mounting portion provided at an end portion of the cylinder on the one axial direction side thereof, the mounting portion may be provided on the outer peripheral surface of the cylinder. In this case, at the portion of the cylinder in which the mounting portion is provided, the outer shape of the fluid actuator is larger in the radial direction by the size of the mounting portion. With this respect, in the above configuration, the maximum value of the orthogonal cross-sectional area in the first fluid chamber 20A is smaller than the maximum value of the orthogonal cross-sectional area in the second fluid chamber 20B. Therefore, although the first mounting portion 22*z* projects outward, the projection of the cylinder 20 in the radially outward direction can be reduced since the orthogonal cross-sectional area of the first fluid chamber 20A is small. The expansion of the fluid actuator 10A can be restricted at the end portion on the axial direction A side of the cylinder 20.

It is possible that the fluid chambers and the hydraulic circuits are connected without the pipes 16. For example, in the above configuration, the manifold 14 is disposed at the same position as the second fluid chamber 20B with respect to the axial direction of the cylinder 20. The interior of the manifold 14 and the second fluid chamber 20B can be connected by aligning through-holes connecting between the inside and the outside of the manifold 14 with ports in the cylinder 20 connected to the second fluid chamber 20B.

The extension length of the cylindrical member 51 of the second piston unit 50 can be modified as appropriate. When the extension length of the cylindrical member 51 is modified, the screw portion 44*z* can extend over the entirety of the portion of the small diameter portion 44 in the first piston unit 40 that is exposed from the cylindrical member 51. Further, the extension length of the coupler 62 and the depth of the coupling hole 62*a* can be modified such that the piston end 60 can be threadably engaged with the entirety of the extension region of the screw portion 44*z*. When the piston end 60 can be threadably engaged with the entirety of the extension region of the screw portion 44*z*, the cylindrical member 51 of the second piston unit 50 can be fixed and compressed between the step surface 40*a* of the first piston unit 40 and the piston end 60. As a result of modifying the extension length of the coupler 62 and the depth of the coupling hole 62*a*, the coupler 62 may reach the interior of the cylinder 20.

The orthogonal cross-sectional areas of the partition chambers may be modified. The orthogonal cross-sectional areas can be squared with the amounts of the hydraulic fluid fed to and discharged from the partition chambers for movement of the piston rod 30. For example, it is possible that the two partition chambers in each of the fluid chambers 20A, 20B have the same orthogonal cross-sectional area, or the first partition chamber 20A1 of the first fluid chamber 20A and the first partition chamber 20B1 of the second fluid chamber 20B have the same orthogonal cross-sectional area. The orthogonal cross-sectional areas of all the partition chambers may be different from one another. The structure of the fluid actuator 10 can be modified such that the partition chambers have the desired orthogonal cross-sectional areas.

The shape of the inner space of the cylinder 20 is not limited to the example in the above embodiment. The inner space may have a rectangular columnar shape. The projection shapes of the first piston 46 and the second piston 52 can be modified in accordance with the shape of the inner space of the cylinder 20.

The number of the fluid chambers is not limited to the example in the above embodiment. Specifically, three or more fluid chambers may be provided.

The object to which the first mounting portion 22*z* is mounted is not limited to the example in the above embodiment. The object to which the second mounting portion 64 is mounted is also not limited to the example in the above embodiment.

The shapes of various components of the fluid actuator 10, such as the first mounting portion 22*z* and the manifold 14, may be modified as appropriate. The positions of the first mounting portion 22*z* and the manifold 14 may also be modified as appropriate.

The materials of the cylinder 20, the piston rod 30, and the manifold 14 are not limited to the examples in the above embodiment. Any material can be used if the fluid actuator 10 is not required to have a high rigidity and a light weight.

It is possible that the seal member S that blocks the gap between the piston rod 30 and the guide member 72 is mounted in the guide member 72 instead of the piston rod 30. The seal member S can be satisfactorily mounted in the guide member 72 if the error in the volumes of the fluid chambers is not considered.

The structure of the piston rod 30 is not limited to the example in the above embodiment. It is not necessary that the second piston unit is fixed between the piston end and the first piston unit if the fatigue strength of the piston rod 30 is not considered.

It is not necessary that the first mode switching valve 126 and the second mode switching valve 226 are switched from the normal mode or the free mode to the damping mode when the moving speed of the piston rod 30 is equal to or greater than a prescribed speed.

The fluid is not limited to oils. The fluid may be a liquid other than oils, or it may be a gas.

The fluid actuator system may be applied to mechanisms other than aircrafts.

A description is hereinafter given of the technical ideas that can be grasped from the above embodiment and its modifications and the advantageous effects thereof.

A fluid actuator including: a cylinder having a columnar inner space, the inner space being partitioned into a plurality of fluid chambers arranged in an axial direction of the inner space; a piston rod inserted in the cylinder toward one axial direction side from the other axial direction side, extending across the plurality of fluid chambers, and having a piston partitioning each of the plurality of fluid chambers into two chambers, the piston rod being configured to reciprocate in the axial direction in accordance with pressures in the plurality of fluid chambers; and a guide member extending from a bottom portion of the cylinder on the one axial direction side toward the other axial direction side, wherein the guide member is inserted in the piston rod, wherein a seal member is interposed between an inner surface of the piston rod and an outer surface of the guide member, and wherein the seal member is mounted in the piston rod.

As in the above configuration, the seal member is mounted in the piston rod that moves instead of the guide member fixed at a position, and therefore, the seal member moves as the piston rod moves. As a result, it can be avoided that the fluid enters the gap between the piston rod and the guide member, irrespective of the position of the piston rod reciprocating. Accordingly, it can be prevented that the volumes of the fluid chambers vary from desired volumes when the fluid enters the gap.

A fluid actuator including: a cylinder having a columnar inner space, the inner space being partitioned into a plurality of fluid chambers arranged in an axial direction of the inner space; and a piston rod inserted in the cylinder toward one axial direction side from the other axial direction side, extending across the plurality of fluid chambers, and having a piston partitioning each of the plurality of fluid chambers into two chambers, the piston rod being configured to reciprocate in the axial direction in accordance with pressures in the plurality of fluid chambers, wherein the piston rod includes a piston end, a first piston unit, and a second piston unit, the piston end is used for mounting an external object to the piston rod, the first piston unit extends from the piston end toward the one axial direction side, and the second piston unit has a cylindrical shape and receives the first piston unit inserted therethrough, wherein the first piston unit includes a first piston, a large diameter portion, and a small diameter portion, the first piston partitions one of the plurality of fluid chambers on the one axial direction side into two chambers, the large diameter portion extends from the first piston toward the other axial direction side, and the small diameter portion extends from the large diameter portion toward the other axial direction side and has a smaller outer diameter than the large diameter portion, wherein the second piston unit includes a second piston and a cylindrical member, the second piston partitions another of the plurality of fluid chambers on the other axial direction side into two chambers, and the cylindrical member has a shorter axial length than the small diameter portion and receives the small diameter portion inserted therethrough, wherein the piston end is threadably engaged with an end portion of the small diameter portion on the other axial direction side, and wherein the second piston unit is fixed between the piston end and a step surface that forms a boundary between the large diameter portion and the small diameter portion of the first piston unit.

By way of an example, a metal member will fatigue and lose its strength after repeated compression and tension, while it is less likely to fatigue when compression or tension is continued. In the above configuration, the second piston unit is less likely to fatigue since it is maintained to be compressed between the piston end and the step surface of the first piston unit. Further, in the above configuration, the piston end that fixes the second piston unit in cooperation with the step surface of the first piston unit is threadably engaged with the small diameter portion of the first piston unit while being pressed by the second piston unit in the direction away from the step surface of the first piston unit.

As a result, the small diameter portion of the first piston unit is maintained to be pulled in the direction away from the step surface, and thus the small diameter portion is less likely to fatigue. As a result of such arrangement, the piston rod has a reinforced fatigue strength.

A fluid actuator including: a cylinder having a columnar inner space and a mounting portion, the inner space being partitioned into a plurality of fluid chambers arranged in an axial direction of the inner space, the mounting portion being disposed on an end portion of the cylinder on one axial direction side of the inner space and configured to be mounted to an external object; and a piston rod extending across the plurality of fluid chambers and having a piston partitioning each of the plurality of fluid chambers into two chambers, the piston rod being configured to reciprocate in the axial direction in accordance with pressures in the plurality of fluid chambers, wherein a maximum value of a cross-sectional area orthogonal to the axial direction related to one of the plurality of fluid chambers at an end on the one axial direction side is smaller than a maximum value of a cross-sectional area orthogonal to the axial direction related to another of the plurality of fluid chambers.

For example, the mounting portion may project outward from an outer surface of the cylinder. Supposing that the plurality of fluid chambers have the same cross-sectional area, the outer shape of the cylinder at the portion where the mounting portion is provided is larger by the size of the mounting portion projecting from the outer surface of the cylinder. In the above configuration, the fluid chamber on the one axial direction side of the cylinder has a small cross-sectional area. Therefore, although the cylinder has a shape with a projecting outer surface, the expansion of the outer shape of the cylinder can be restricted since the cross-sectional area of the fluid chamber is small.

A fluid actuator including: a cylinder having a columnar inner space and a mounting portion, the inner space being partitioned into two fluid chambers arranged in an axial direction of the inner space, the mounting portion being disposed on an end portion of the cylinder on one axial direction side of the inner space and configured to be mounted to an external object; a piston rod extending across the two fluid chambers and having a piston partitioning each of the two fluid chambers into two chambers, the two chambers including a first partition chamber positioned on the one axial direction side and a second partition chamber positioned on the other axial direction side, the piston rod being configured to reciprocate in the axial direction in accordance with pressures in the two fluid chambers; and a manifold mounted to the cylinder and containing a hydraulic circuit of a fluid to be fed to and discharged from the two fluid chambers, wherein in the cylinder, a wall portion partitioning one of the two fluid chambers positioned on the one axial direction side is made of an iron-based alloy, and a radially outside wall portion partitioning another of the two fluid chambers positioned on the other axial direction side is made of an aluminum alloy, wherein the piston rod is made of an iron-based alloy, wherein the manifold is made of an aluminum alloy, wherein the fluid circuit and the two fluid chambers are connected via a pipe extending from the manifold to the cylinder, wherein the fluid actuator further comprises a guide member extending from a bottom portion of the cylinder on the one axial direction side toward the other axial direction side, wherein the guide member is inserted in the piston rod, wherein a seal member is interposed between an inner surface of the piston rod and an outer surface of the guide member, wherein the seal member is mounted in the piston rod, wherein the piston rod includes a piston end, a first piston unit, and a second piston unit, the piston end is used for mounting an external object to the piston rod, the first piston unit extends from the piston end toward the one axial direction side, and the second piston unit has a cylindrical shape and receives the first piston unit inserted therethrough, wherein the first piston unit includes a first piston, a large diameter portion, and a small diameter portion, the first piston partitions one of the two fluid chambers on the one axial direction side into two chambers, the large diameter portion extends from the first piston toward the other axial direction side, and the small diameter portion extends from the large diameter portion toward the other axial direction side and has a smaller outer diameter than the large diameter portion, wherein the second piston unit includes a second piston and a cylindrical member, the second piston partitions the other of the two fluid chambers on the other axial direction side into two chambers, and the cylindrical member has a shorter axial length than the small diameter portion and receives the small diameter portion inserted therethrough, wherein the piston end is threadably engaged with an end portion of the small diameter portion on the other axial direction side, and wherein the second piston unit is fixed between the piston end and a step surface that forms a boundary between the large diameter portion and the small diameter portion of the first piston unit, wherein in one of the two fluid chambers on the one axial direction side, a cross-sectional area orthogonal to the axial direction related to the first partition chamber is larger than a cross-sectional area orthogonal to the axial direction related to the second partition chamber, wherein in the other of the two fluid chambers on the other axial direction side, a cross-sectional area orthogonal to the axial direction related to the second partition chamber is larger than a cross-sectional area orthogonal to the axial direction related to the first partition chamber.

A cylinder is basically required to have rigidity, for example, in the vicinity of a mounting portion. In addition, in the cylinder, a pressure produced by movement of the piston tends to act on the wall portions positioned on the axis of the cylinder such as the wall portion partitioning adjacent fluid chambers. Therefore, a high rigidity is required in these wall portions. On the other hand, the wall portions defining the radially outer side of the fluid chambers receive less pressure produced by the movement of the piston. Therefore, the wall portions defining the radially outer side of the fluid chambers are not required to have as high a rigidity as the portions in the vicinity of the coupling portion. Such wall portions can be made of an aluminum alloy to reduce the weight of the cylinder. Further, the manifold mounted to the cylinder can also be made of an aluminum alloy, thus reducing the weight of the fluid actuator.

A fluid actuator including: a cylinder having a columnar inner space, the inner space being partitioned into a plurality of fluid chambers arranged in an axial direction of the inner space; a piston rod extending across the plurality of fluid chambers and having a piston partitioning each of the plurality of fluid chambers into two chambers, the two chambers including a first partition chamber positioned on one axial direction side and a second partition chamber positioned on the other axial direction side, the piston rod being configured to reciprocate in the axial direction in accordance with pressures in the plurality of fluid chambers; and a passage switching valve for switching feeding and discharging operations for the first partition chamber and the second partition chamber of each of the plurality of fluid chambers, wherein the passage switching valve is provided for each of the plurality of fluid chambers.

In the above configuration, even supposing that a malfunction occurs in the passage switching valve associated with one fluid chamber, passage switching valves associated with the other fluid chambers can be operated. Therefore, a failure of the piston rod can be prevented.

It is possible that the fluid actuator system further includes a manifold mounted to the cylinder and containing a hydraulic circuit of a fluid to be fed to and discharged from the fluid chambers, and the manifold contains the passage switching valves.

In the above configuration, since the manifold mounted to the cylinder contains the passage switching valves, the passage switching valves can be positioned near the fluid chambers. Therefore, the channels extending from the passage switching valves to the fluid chambers can be short.

A fluid actuator including: a cylinder having a columnar inner space, the inner space being partitioned into a plurality of fluid chambers arranged in an axial direction of the inner space; a piston rod extending across the plurality of fluid chambers and having a piston partitioning each of the plurality of fluid chambers into two chambers, the two chambers including a first partition chamber positioned on one axial direction side and a second partition chamber positioned on the other axial direction side, the piston rod being configured to reciprocate in the axial direction in accordance with pressures in the plurality of fluid chambers; and a mode switching valve for switching between a normal mode, a damping mode, and a free mode, wherein in the normal mode, a feeding passage for feeding a fluid is allowed to communicate with any one of the first partition chamber and the second partition chamber, and a discharging passage for discharging the fluid is allowed to communicate with the other of the first partition chamber and the second partition chamber, wherein in the damping mode, the communication between the fluid chambers and both the feeding passage and the discharging passage is disconnected, and the first partition chamber and the second partition chamber are allowed to communicate with each other via an orifice, wherein in the free mode, the communication between the fluid chambers and both the feeding passage and the discharging passage is disconnected, and the first partition chamber and the second partition chamber of each of the plurality of fluid chambers are allowed to communicate with each other without a medium of the orifice, wherein the mode switching valve is provided for each of the plurality of fluid chambers.

In the damping mode, the orifice damps the flow of the fluid between the first partition chamber and the second partition chamber of the fluid chambers in both directions. Accordingly, the movement of the piston rod is damped. Supposing that the mode switching valve has a malfunction and cannot switch to the second mode, the movement of the piston rod cannot be damped. In the above configuration, the mode switching valve is provided for each of the fluid chambers, and therefore, even supposing that a malfunction occurs in the mode switching valve associated with one fluid chamber, mode switching valves associated with the other fluid chambers can be operated. Accordingly, the mode switching valves free of a malfunction can be switched to the second mode to damp the movement of the piston rod.

A fluid actuator including: a cylinder having a columnar inner space, the inner space being partitioned into a plurality of fluid chambers arranged in an axial direction of the inner space; a piston rod extending across the plurality of fluid chambers and having a piston partitioning each of the plurality of fluid chambers into two chambers, the two chambers including a first partition chamber positioned on one axial direction side and a second partition chamber positioned on the other axial direction side, the piston rod being configured to reciprocate in the axial direction in accordance with pressures in the plurality of fluid chambers; and a mode switching valve for switching between a normal mode, a damping mode, and a free mode, wherein in the normal mode, a feeding passage for feeding a fluid is allowed to communicate with any one of the first partition chamber and the second partition chamber, and a discharging passage for discharging the fluid is allowed to communicate with the other of the first partition chamber and the second partition chamber, wherein in the damping mode, the communication between the fluid chambers and both the feeding passage and the discharging passage is disconnected, and the first partition chamber and the second partition chamber of each of the plurality of fluid chambers are allowed to communicate with each other via an orifice, wherein in the free mode, the communication between the fluid chambers and both the feeding passage and the discharging passage is disconnected, and the first partition chamber and the second partition chamber of each of the plurality of fluid chambers are allowed to communicate with each other without a medium of the orifice; a controller for controlling switching of the mode switching valve; and a sensing device for sensing a moving speed of the piston rod for a predetermined amount of time, wherein the controller switches the mode switching valve from the normal mode or the free mode to the damping mode when the moving speed of the piston rod is equal to or greater than a prescribed speed.

In the above configuration, the mode switching valve is switched to the damping mode when the piston rod moves excessively fast in accordance with the movement of an external object mounted to the piston rod. Therefore, the movement of the piston rod can be damped.

A fluid actuator including: a cylinder having a columnar inner space, the inner space being partitioned into two fluid chambers arranged in an axial direction of the inner space; a piston rod extending across the two fluid chambers and having a piston partitioning each of the two fluid chambers into two chambers, the two chambers including a first partition chamber positioned on one axial direction side and a second partition chamber positioned on the other axial direction side, the piston rod being configured to reciprocate in the axial direction in accordance with pressures in the two fluid chambers; a first passage switching valve for allowing a first feeding passage for feeding a fluid to communicate with any one of the first partition chamber of the fluid chamber on the one axial direction side and the second partition chamber of the fluid chamber on the other axial direction side, and allowing a first discharging passage for discharging the fluid to communicate with the other of the first partition chamber of the fluid chamber on the one axial direction side and the second partition chamber of the fluid chamber on the other axial direction side; a first compensator disposed on an intermediate portion of the first discharging passage and configured to store the fluid and feed the fluid toward the first passage switching valve in accordance with a pressure on a first passage switching valve side; a second passage switching valve for allowing a second feeding passage for feeding the fluid to communicate with any one of the second partition chamber of the fluid chamber on the one axial direction side and the first partition chamber of the fluid chamber on the other axial direction side, and allowing a second discharging passage for discharging the fluid to communicate with the other of the second partition chamber of the fluid chamber on the one axial direction side and the first partition chamber of the fluid chamber on the other axial direction side; and a second compensator disposed on an intermediate portion of the second discharging passage and configured to store the fluid and feed the fluid toward the second passage switching valve in accordance with a pressure on a second passage switching valve side, wherein a cross-sectional area orthogonal to the axial direction related to the first partition chamber of the fluid chamber on the one axial direction side is the same as the cross-sectional area related to the second partition chamber of the fluid chamber on the other axial direction side, and wherein a cross-sectional area orthogonal to the axial direction related to the second partition chamber of the fluid chamber on the one axial direction side is the same as a cross-sectional area orthogonal to the axial direction related to the first partition chamber of the fluid chamber on the other axial direction side.

In the above configuration, since the two partition chambers connected to the first passage switching valve have the same cross-sectional area, substantially the same amount of fluids can be fed and discharged via the first passage switching valve. Therefore, it can be prevented that the amount of the fluid stored in the first compensator varies in accordance with the movement of the piston rod. The same applies to the second compensator.

In the fluid actuator system, for the two chambers of each of the fluid chambers partitioned by the piston, a cross-sectional area orthogonal to the axial direction related to the first partition chamber may be different from a cross-sectional area orthogonal to the axial direction related to the second partition chamber.

The piston rod may move in accordance with the movement of an external object mounted to the piston rod. At a moment when the piston rod moves, the piston rod will move with substantially no fluid flowing into or out of the first partition chamber and the second partition chamber. In the above configuration, the first partition chamber and the second partition chamber have different cross-sectional areas. Therefore, when the piston is positioned around the axial middle of a fluid chamber, the first partition chamber and the second partition chamber have different volumes. In this configuration, when substantially no fluid flows into or out of the first partition chamber and the second partition chamber, a force acts on the piston in the direction described as follows. The force acts from the first or second partition chamber having the larger volume produced by the larger cross-sectional area toward the other partition chamber having the smaller volume produced by the smaller cross-sectional area. For example, when in some of the plurality of fluid chambers, the first partition chamber has the larger orthogonal cross-sectional area, while in the other fluid chambers, the second partition chamber has the larger orthogonal cross-sectional area, and these fluid chambers are arranged randomly, the piston rod receives a force acting toward the one axial direction side of the cylinder and a force acting toward the other axial direction side. The piston rod receiving these forces is inhibited from moving in the axial direction. This is favorable in suppressing the movement of the piston rod.

In the fluid actuator system, there are two fluid chambers provided. In one of the two fluid chambers, the partition chamber having the larger cross-sectional area among the two partition chambers may be positioned on the one axial direction side, while in the other fluid chamber, the partition chamber having the larger cross-sectional area among the two partition chambers may be positioned on the other axial direction side.

For example, in the fluid chamber on the one axial direction side of the cylinder, the first partition chamber has a larger cross-sectional area than the second partition chamber, while in the other fluid chamber, the second partition chamber has a larger cross-sectional area than the first partition chamber. In this configuration, at a moment when the piston rod moves in accordance with the movement of an external object mounted to the piston rod, or when substantially no fluid flows into or out of the first partition chamber and the second partition chamber, the piston supposed to be positioned around the axial middle of a fluid chamber receives forces acting thereon in the directions described as follows. In the fluid chamber on the one axial direction side, a force acts from the first partition chamber toward the second partition chamber, or toward the other axial direction side of the cylinder. In the fluid chamber on the other axial direction side, a force acts from the second partition chamber toward the first partition chamber, or toward the one axial direction side of the cylinder. In other words, with respect to the axial direction of the cylinder, the piston rod receives the forces acting thereon from both its sides toward the middle of the cylinder, and therefore, the piston rod is easily retained in the position around the middle.

What is claimed is:

1. A fluid actuator comprising:

a cylinder having a columnar inner space and a mounting portion, the inner space being partitioned into a plurality of fluid chambers arranged in an axial direction of the inner space, the mounting portion being disposed on an end portion of the cylinder on one axial direction side of the inner space and configured to be mounted to an external object; and a piston rod extending across the plurality of fluid chambers and having pistons each partitioning a respective one of the plurality of fluid chambers into two sub-chambers, the piston rod being configured to reciprocate in the axial direction in accordance with pressures in the two sub-chambers of each of the plurality of fluid chambers, wherein in the cylinder, a first wall portion surrounding one of the plurality of fluid chambers positioned at an end on the one axial direction side is integrally and seamlessly formed with the mounting portion, the first wall portion and the mounting portion are made of an iron-based alloy, and a second wall portion surrounding another of the plurality of fluid chambers positioned on the other axial direction side beyond the one of the plurality of fluid chambers positioned at the end on the one axial direction side is made of an aluminum alloy, and wherein the piston rod is made of an iron-based alloy.

2. The fluid actuator of claim 1, further comprising: a manifold mounted to the cylinder and containing a hydraulic circuit of a fluid to be fed to and discharged from the sub-chambers, wherein the manifold is made of an aluminum alloy.

3. The fluid actuator of claim 2, wherein the hydraulic circuit and the sub-chambers are connected via respective pipes extending from the manifold to the cylinder.

4. The fluid actuator of claim 1, wherein the two sub-chambers of the one of the plurality of fluid chambers include a first sub-chamber positioned on the one axial direction side and a second sub-chamber positioned on the other axial direction side, and wherein a cross-sectional area orthogonal to the axial direction related to the first sub-chamber is different from a cross-sectional area orthogonal to the axial direction related to the second sub-chamber.

5. The fluid actuator of claim 4, wherein the plurality of fluid chambers comprises two fluid chambers, wherein in the one of the two fluid chambers, the first sub-chamber has a larger cross-sectional area, and wherein in the other of the two fluid chambers, one of the two sub-chambers having a larger cross-sectional area is positioned on the other axial direction side.

* * * * *